US010788287B2

(12) United States Patent
Parker et al.

(10) Patent No.: US 10,788,287 B2
(45) Date of Patent: Sep. 29, 2020

(54) ADJUSTABLE STOCK FOR FIREARM

(71) Applicant: Sturm, Ruger & Company, Inc., Southport, CT (US)

(72) Inventors: Benjamin Keyes Parker, Stokesdale, NC (US); Jonathan Philip Mather, Grafton, NH (US); Jarod John Wendholt, Jasper, IN (US); Robert Earl Craig, Eden, NC (US); Matthew Scott Willson, Walnut Cove, NC (US); Nathan Brown, Kernersville, NC (US)

(73) Assignee: Sturm, Ruger & Company, Inc.

( * ) Notice: Subject to any disclaimer, the term of this patent is extended or adjusted under 35 U.S.C. 154(b) by 90 days.

(21) Appl. No.: 16/171,594

(22) Filed: Oct. 26, 2018

(65) Prior Publication Data

US 2019/0128639 A1 May 2, 2019

Related U.S. Application Data

(60) Provisional application No. 62/578,062, filed on Oct. 27, 2017.

(51) Int. Cl.
*F41C 23/14* (2006.01)
*F41C 23/04* (2006.01)

(52) U.S. Cl.
CPC ..... *F41C 23/14* (2013.01); *F41C 23/04* (2013.01)

(58) Field of Classification Search
CPC ..... F41C 23/174; F41C 23/04
USPC ..... 42/73
See application file for complete search history.

(56) References Cited

U.S. PATENT DOCUMENTS 4,896,446 A 1/1990 Gregory
5,031,348 A * 7/1991 Carey ..... F41C 23/06 42/71.01
5,392,553 A * 2/1995 Carey ..... F41C 23/14 42/73
5,410,833 A 5/1995 Paterson
5,970,642 A 10/1999 Martin
7,428,794 B2 9/2008 Oz
7,640,688 B2 * 1/2010 Oz ..... F41C 23/14 42/71.01
7,647,719 B2 1/2010 Fitzpatrick
(Continued)

OTHER PUBLICATIONS

International Search Report and Written Opnion, Patent Cooperation Treaty, dated Jan. 7, 2019, pp. 1-16.
(Continued)

*Primary Examiner* — Michelle Clement
(74) *Attorney, Agent, or Firm* — The Belles Group, P.C.

(57) ABSTRACT

An adjustable stock for a firearm includes a longitudinally-extending chassis supporting a receiver, a butt pad assembly adjustable in longitudinal position for varying the length of pull, and a cheek rest. The cheek rest is adjustable in longitudinal and vertical positions. A triple-acting locking mechanism having locked and unlocked positions is operable to simultaneously lock the butt pad assembly in longitudinal position and the cheek rest in both longitudinal and vertical positions. The locking mechanism may be a cam lever assembly in non-limiting examples having a pivotable cam lever operable to simultaneously unlock or lock the butt pad assembly and cheek rest, thereby providing a single point of operation for making all the foregoing stock adjustments.

25 Claims, 38 Drawing Sheets

(56) References Cited

U.S. PATENT DOCUMENTS

| | | | | |
|---|---|---|---|---|
| 7,930,849 | B2 * | 4/2011 | Abraham | F41C 23/14 42/73 |
| 8,061,072 | B1 | 11/2011 | Crose | |
| 8,141,288 | B2 | 3/2012 | Dodd et al. | |
| 8,186,090 | B1 * | 5/2012 | Chiarolanza | F41C 23/04 42/73 |
| 8,381,427 | B2 | 2/2013 | Nill | |
| 8,402,683 | B2 | 3/2013 | Cabahug et al. | |
| 8,453,365 | B1 | 6/2013 | Ballard | |
| D704,294 | S | 5/2014 | Jarboe | |
| 8,720,099 | B1 | 5/2014 | Sisk | |
| 8,763,296 | B1 * | 7/2014 | Chvala | F41C 23/14 42/73 |
| 8,844,185 | B2 * | 9/2014 | Jarboe | F41C 23/04 42/73 |
| D722,672 | S | 2/2015 | Juarez | |
| 8,950,099 | B2 | 2/2015 | Rogers et al. | |
| 8,955,245 | B2 * | 2/2015 | Chvala | F41C 23/14 42/1.06 |
| D733,247 | S | 6/2015 | Lewis | |
| D736,336 | S | 8/2015 | Mayberry et al. | |
| 9,360,272 | B2 * | 6/2016 | Hopkins | F41C 23/14 |
| D763,396 | S | 8/2016 | Juarez | |
| 9,404,708 | B1 | 8/2016 | Chow et al. | |
| 9,410,764 | B2 | 8/2016 | Jarboe | |
| 9,464,863 | B2 * | 10/2016 | Mather | F41C 23/14 |
| D774,619 | S | 12/2016 | Mather | |
| 9,546,845 | B2 * | 1/2017 | Mather | F41A 3/66 |
| 9,574,844 | B2 * | 2/2017 | Williams | F41B 11/721 |
| 9,664,476 | B1 * | 5/2017 | Robinson | F41C 23/14 |
| 9,664,479 | B1 * | 5/2017 | Robinson | F41C 23/14 |
| 10,215,526 | B2 * | 2/2019 | Shinkle | F41C 23/14 |
| D868,924 | S | 12/2019 | Nuss et al. | |
| D871,536 | S | 12/2019 | Lessard et al. | |
| 2006/0254111 | A1 | 11/2006 | Giauque et al. | |
| 2007/0101631 | A1 * | 5/2007 | Bentley | F41C 23/14 42/74 |
| 2007/0289190 | A1 | 12/2007 | Oz | |
| 2008/0028662 | A1 * | 2/2008 | Abraham | F41C 23/14 42/73 |
| 2012/0036757 | A1 * | 2/2012 | Larue | F41C 23/14 42/73 |
| 2014/0245649 | A1 * | 9/2014 | Fluhr | F41C 23/14 42/73 |
| 2014/0259848 | A1 * | 9/2014 | Chvala | F41C 23/14 42/73 |
| 2014/0360074 | A1 | 12/2014 | Jarboe | |
| 2015/0338186 | A1 | 11/2015 | Hopkins | |
| 2015/0345881 | A1 | 12/2015 | Irvin | |
| 2016/0084612 | A1 | 3/2016 | Robinson et al. | |
| 2016/0116250 | A1 * | 4/2016 | Mather | F41C 23/04 42/73 |
| 2016/0187092 | A1 | 6/2016 | Mather et al. | |
| 2016/0202016 | A1 * | 7/2016 | Mather | F41C 23/14 42/73 |
| 2017/0059271 | A1 | 3/2017 | Bowen | |
| 2017/0122698 | A1 * | 5/2017 | Chu | F41C 23/20 |
| 2018/0202756 | A1 * | 7/2018 | Shinkle | F41C 23/14 |
| 2018/0335273 | A1 * | 11/2018 | Doty | F41C 23/14 |
| 2019/0056192 | A1 * | 2/2019 | Frazier | F41C 23/14 |
| 2019/0128639 | A1 * | 5/2019 | Parker | F41C 23/14 |
| 2019/0301831 | A1 * | 10/2019 | Inneci | F41C 23/04 |

OTHER PUBLICATIONS

Magpul PRS Gen3 Precision—Adjustable Stock (Options)—MSR Arms, LLC. Retrieved from the Internet at: https://msrarms.com/ 2017. US.

Rob Reaser; The AR-15 You Can't Afford Not to Buy, Article, Shooting Daily. Jul. 6, 2015. US.

* cited by examiner

ADJUSTABLE STOCK FOR FIREARM

CROSS-REFERENCE TO RELATED APPLICATIONS

The present application claims the benefit of priority to U.S. Provisional Application No. 62/578,062 filed Oct. 27, 2017; the entirety of which is incorporated herein by reference.

BACKGROUND

The present invention generally relates to firearm stocks, and more particularly to an adjustable buttstock for a firearm that provides adjustment to the length of pull of the firearm and position of an adjustable cheek rest.

There are many types of rifle buttstocks that allow the user to make adjustments to the length of pull and cheek rest height to improve the fit of the rifle to the individual user. Many different methods are used to secure and release the moving pieces. Some stocks require the loosening and tightening of nuts and bolts to change positions. This can create a very solid stock with a high amount of adjustability, but making adjustments in the field can be difficult and time consuming.

Other stocks use a threaded jackscrew type mechanism, to raise and lower the cheek rest, or move the butt stock length. These require no tools and can be moved in small increments, but can be time consuming to make large adjustments, and usually allow a small amount of movement between the parts.

Another method uses a notched adjustment rod in combination with a spring loaded locking button. Pressing the button releases the notched rod, allowing the butt pad, or cheek rest, to be moved to a different position, where the spring loaded button will re-engage the notch. These adjustments are easy to make, but also allow a small amount of movement between parts.

Some stocks just use thumb nuts or bolts to clamp the cheek rest at a given position. These are inexpensive and easy to operate, but are also prone to loosening and moving out of position. Several stocks use cam levers to retain a position, but they may still require tools, or multi-handed adjustment methods to properly set the cam tension.

An improved adjustable stock design is desired.

SUMMARY

The present disclosure provides an adjustable rifle stock, more particularly a buttstock assembly, that uses a single locking mechanism to secure the movable components of the buttstock assembly into position on a unitary chassis. The movable components of the buttstock assembly comprise a butt pad assembly adjustable in longitudinal (axial) position and a cheek rest adjustable in both longitudinal and vertical position. The buttstock assembly thus provides length of pull adjustment features and cheek rest adjustment features allowing a user to highly customize the buttstock for comfort and fit to accommodate different physiques and preferences.

In one embodiment, the locking mechanism may comprise a spring-biased cam lever assembly changeable between locked and unlocked states or positions. The cam lever assembly includes a pivotably mounted cam lever movable between a release position in which the cam lever assembly is in a locked state, and at least one locking position in which the cam lever assembly is in the unlocked state. The cam lever assembly described herein is more rigid and less likely to unintentionally move from the set locked position either due to vibrations generated by discharging the firearm, or by accidental contact with the user or other object during handling. In one embodiment, a double-acting cam lever and tool free adjustment methods are disclosed that make the cam lever easier to operate by the user with a single hand and provides two different locking positions of the cam lever which accommodates both short and long stock configurations without interference from the handle.

The adjustable buttstock according to the present disclosure advantageously uses a single triple action cam lever assembly to release and lock the length of pull adjustment (i.e. length of buttstock assembly) and both the cheek rest height and longitudinal position on the firearm. Advantageously, the double-acting cam lever described herein has the benefit of being able to secure a moving part as tight as a wrench installed fastener, but with the ability of being able to adjust it without tools. There are several features that make the cam levers used on the present buttstock different from the prior stocks described above.

First, the cam lever is double acting in one embodiment, meaning it provides no camming or locking action in its open center release position, but provides equal displacement of the locking mechanism when pushed in either direction. This beneficially allows the user to locate the cam lever in one of two possible closed locking positions to suit both individual preferences and avoid interference with the other parts of the firearm or accessories depending on the locked positions selected.

Second, another notable difference of the two double-acting cam lever presented herein is the method used for adjustment. Like any cam with a relatively hard stop, if the length of the cam rod is not set precisely, the cam will either remain loose when closed, or be too tight to require excessive force to move it into the closed position. By contrast in the present invention, easy tool-free adjustment is enabled through the combination of the spring loaded cam lever, and unique detent finger nut and ribbed washer as further described herein.

In one respect, an adjustable stock assembly for a firearm comprises: a longitudinal axis; a chassis comprising a main body configured for mounting a receiver and an axially elongated rear mounting extension extending rearwardly from the main body; a butt pad assembly slideably coupled to the rear mounting extension, the butt pad assembly slideable between a plurality of axial positions on the rear mounting extension for adjusting a length of pull of the firearm; a cheek rest slideably coupled to the rear mounting extension, the cheek rest slideable between a plurality of vertical positions on the rear extension; and a locking mechanism coupled to the rear mounting extension and changeable between a locked and unlocked position, the locking mechanism configured to simultaneously lock both the butt pad assembly in one of the axial positions and the cheek rest in one of the vertical positions respectively.

In another respect, an adjustable stock assembly for a firearm comprises: a longitudinal axis; a chassis comprising a main body configured for mounting a receiver and an axially elongated rear mounting extension extending rearwardly from the main body; a cam lever assembly mechanically coupled to the rear mounting extension, the cam lever assembly comprising a cam lever pivotably movable between a locking position and a release position; the cam lever assembly further comprising a pair of spring-biased clamping blocks coupled to the rear mounting extension, the clamping blocks laterally movable together and apart via operation of the cam lever between a closed position and an open position; a butt pad assembly comprising an elongated butt pad and an adjustment rail protruding axially forward from the butt pad into a longitudinal cavity of the rear mounting extension of the chassis, the adjustment rail received between the clamping blocks and slideable between a plurality of axial positions for adjusting a length of the butt pad; the clamping blocks when in the closed position lockingly engaging the adjustment rail in one of the axial positions, and when in the open position allowing the adjustment rail to slide axially relative to the rear mounting extend between the axial positions; and a cheek rest slideably mounted to the rear mounting extension, the cheek rest slideable between a plurality of vertical positions on the rear extension; the cam lever assembly operable to simultaneously lock both the butt pad assembly and cheek rest in one of the axial positions and vertical positions respectively.

In another respect, an adjustable stock assembly for a firearm, the stock comprises: a longitudinal axis; a chassis configured for mounting a receiver thereto and comprising an axially elongated rear mounting extension extending rearwardly from the main body; a locking mechanism slideably coupled to the rear mounting extension and changeable between a locked and unlocked position, the locking mechanism movable between a plurality of first longitudinal positions on the rear mounting extension; a butt pad assembly slideably mounted to the rear mounting extension, the butt pad assembly slideable between a plurality of second longitudinal positions on the rear mounting extension for adjusting a length of pull of the firearm; a cheek rest mounted to the locking mechanism, the cheek rest slideable with the locking mechanism between the plurality of first longitudinal positions on the rear extension; the locking mechanism configured to simultaneously lock both the butt pad assembly in one of the second longitudinal positions and the cheek rest in one of first longitudinal positions.

Further areas of applicability of the present invention will become apparent from the detailed description provided hereinafter.

BRIEF DESCRIPTION OF THE DRAWINGS

The features of the exemplary embodiments will be described with reference to the following drawings where like elements are labeled similarly, and in which:

All drawings are schematic and not necessarily to scale. Parts given a reference numerical designation in one figure may be considered to be the same parts where they appear in other figures without a numerical designation for brevity unless specifically labeled with a different part number and/or described herein. Parts described herein with respect to certain figures may also appear in other figures in which they may be numbered or unnumbered unless otherwise noted herein. Furthermore, a general reference to a whole figure number (e.g. FIG. 6) which may include multiple alphabetic subparts (e.g. FIGS. 6A, 6B, etc.) shall be construed as a reference to all of the subparts unless specifically noted otherwise.

DETAILED DESCRIPTION

Figure 1:
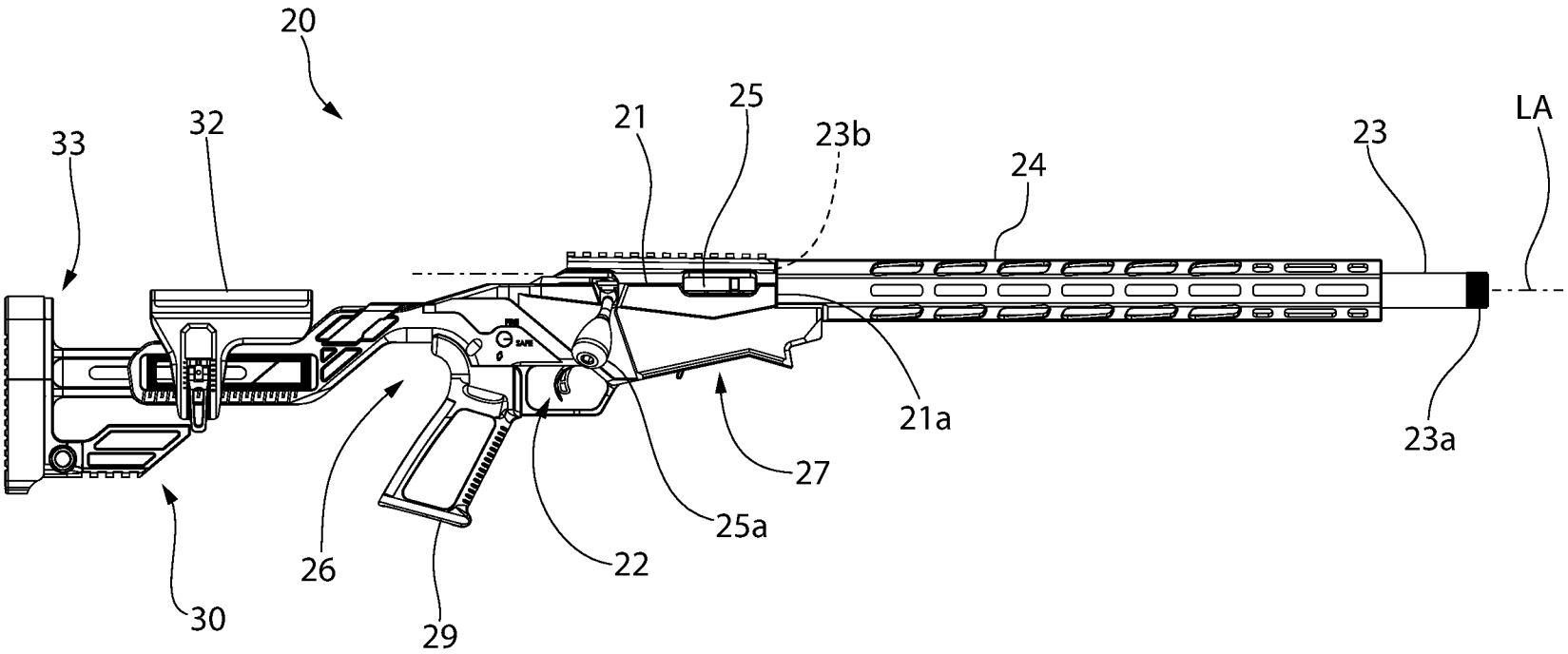
FIG. 1 is a longitudinal side view of one embodiment of a firearm with a stock including an adjustable buttstock assembly according to the present disclosure.
Figure 2:
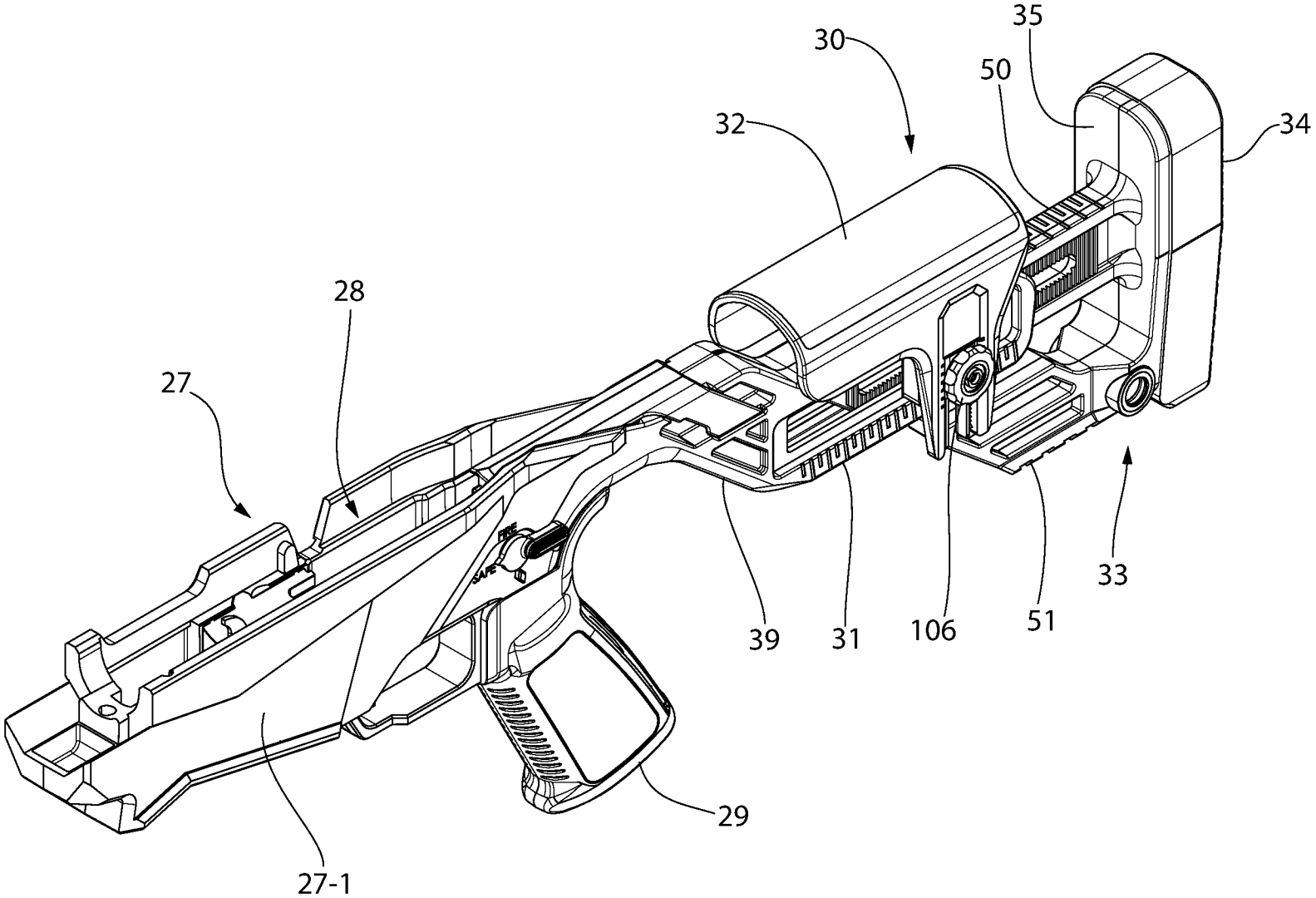
FIG. 2 is a top perspective view of the stock of FIG. 1.
Figure 3:
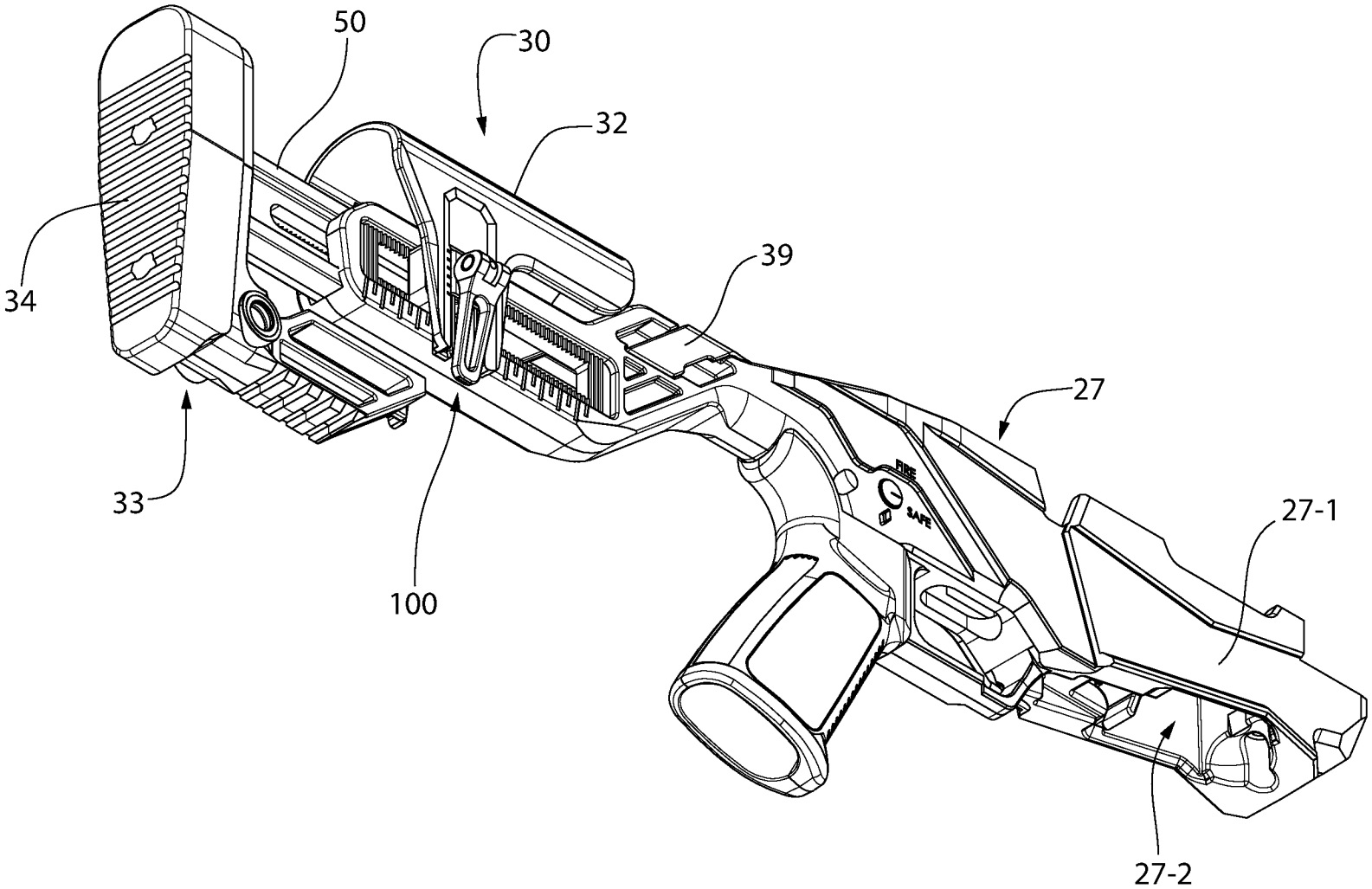
FIG. 3 is a bottom perspective view thereof.
Figure 4:
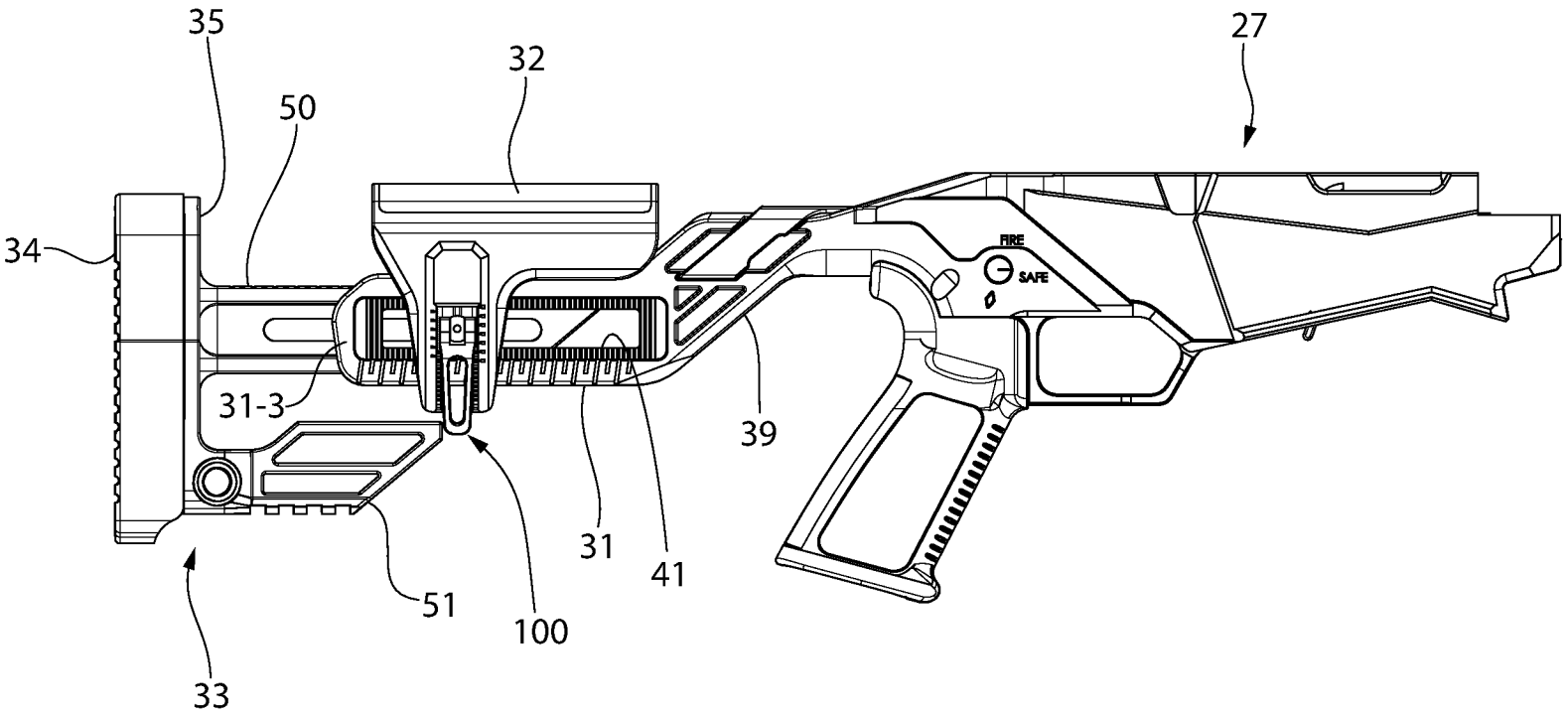
FIG. 4 is a right lateral side view thereof.
Figure 5:
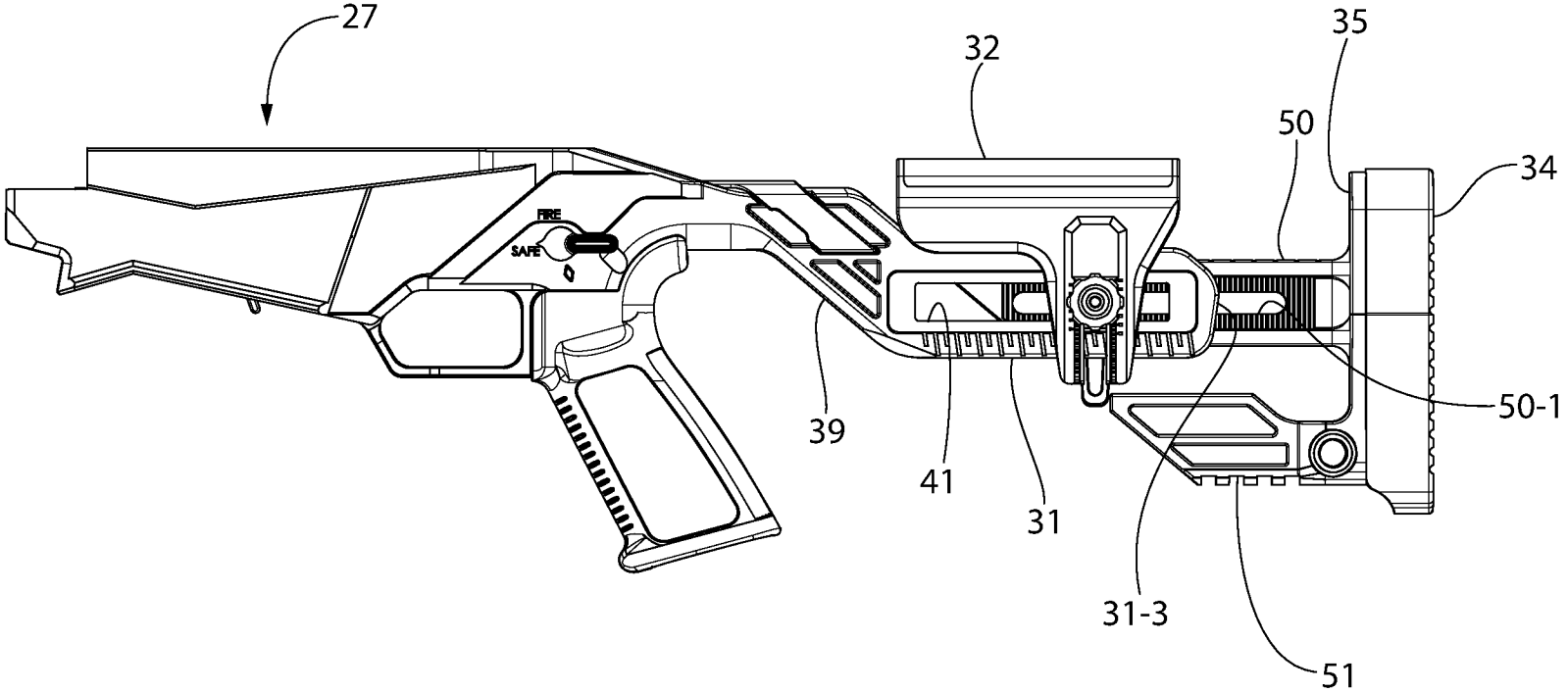
FIG. 5 is a left lateral side view thereof.
Figure 6:
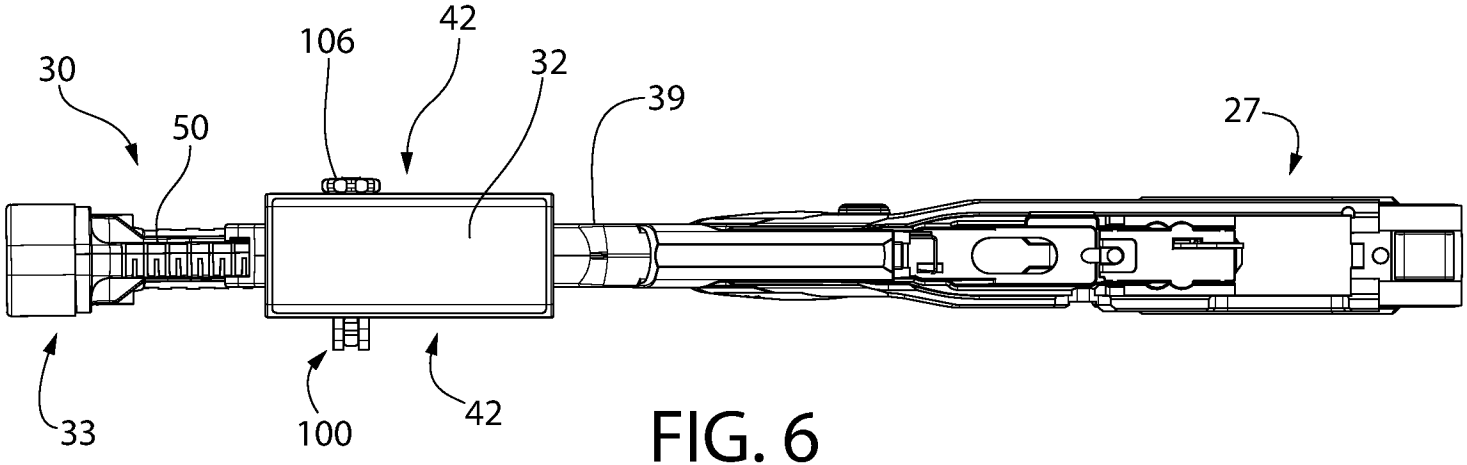
FIG. 6 is a top view thereof.
Figure 7:
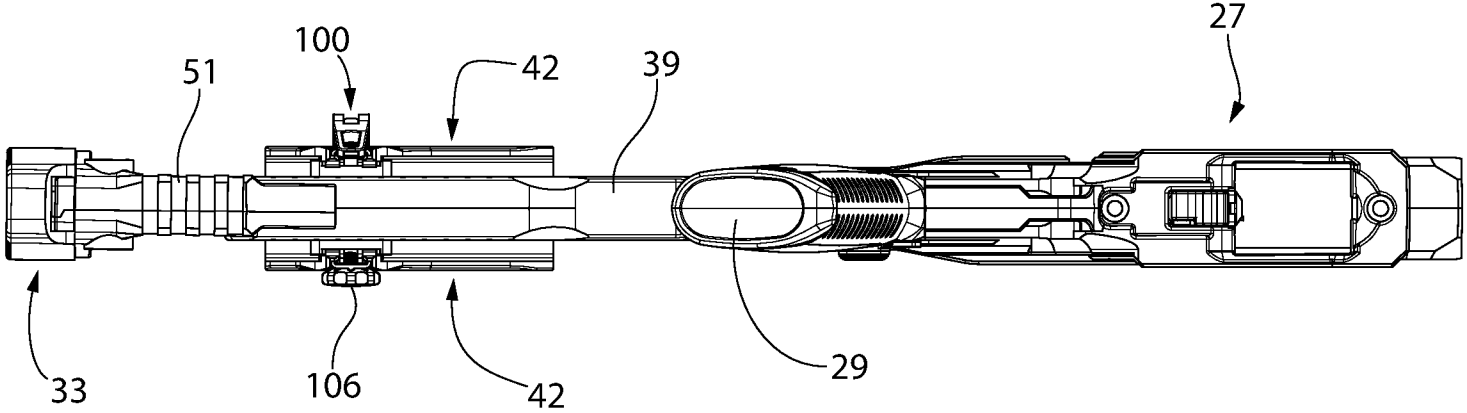
FIG. 7 is a bottom view thereof.
Figure 8:
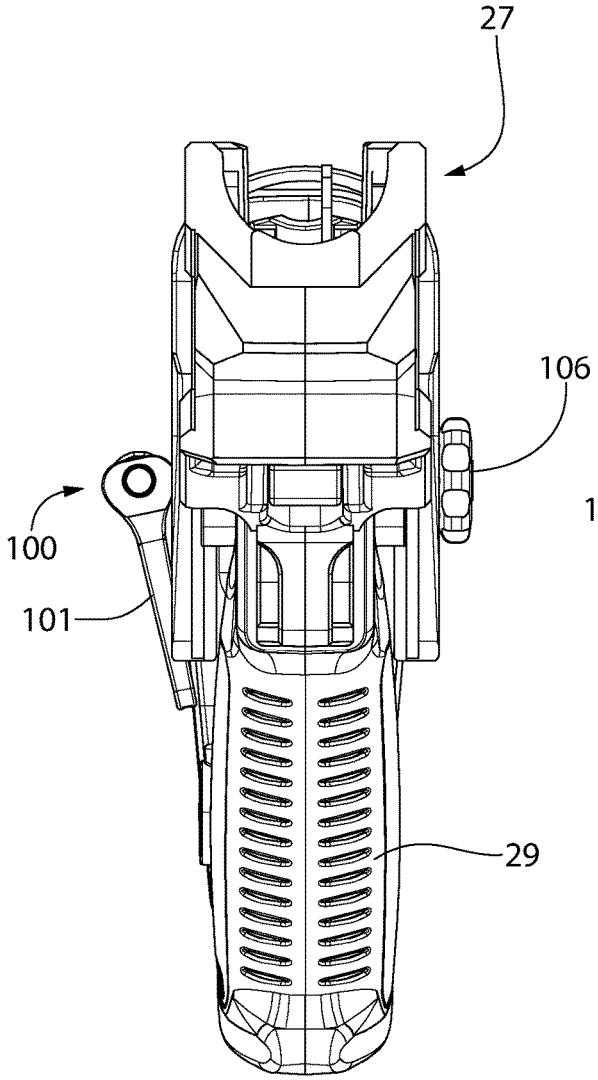
FIG. 8 is front view thereof.
Figure 9:
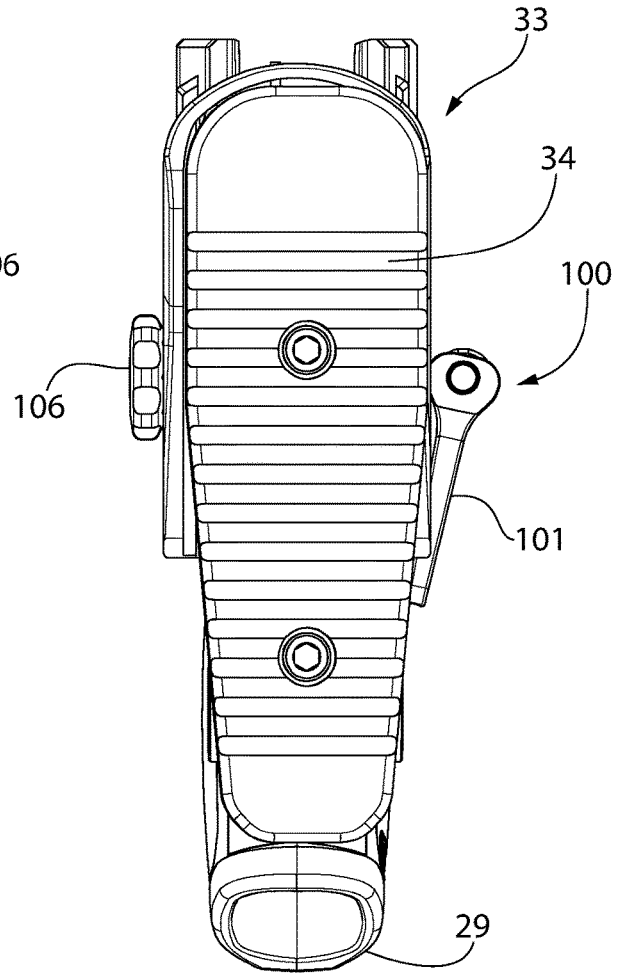
FIG. 9 is a rear view thereof.
Figure 10:
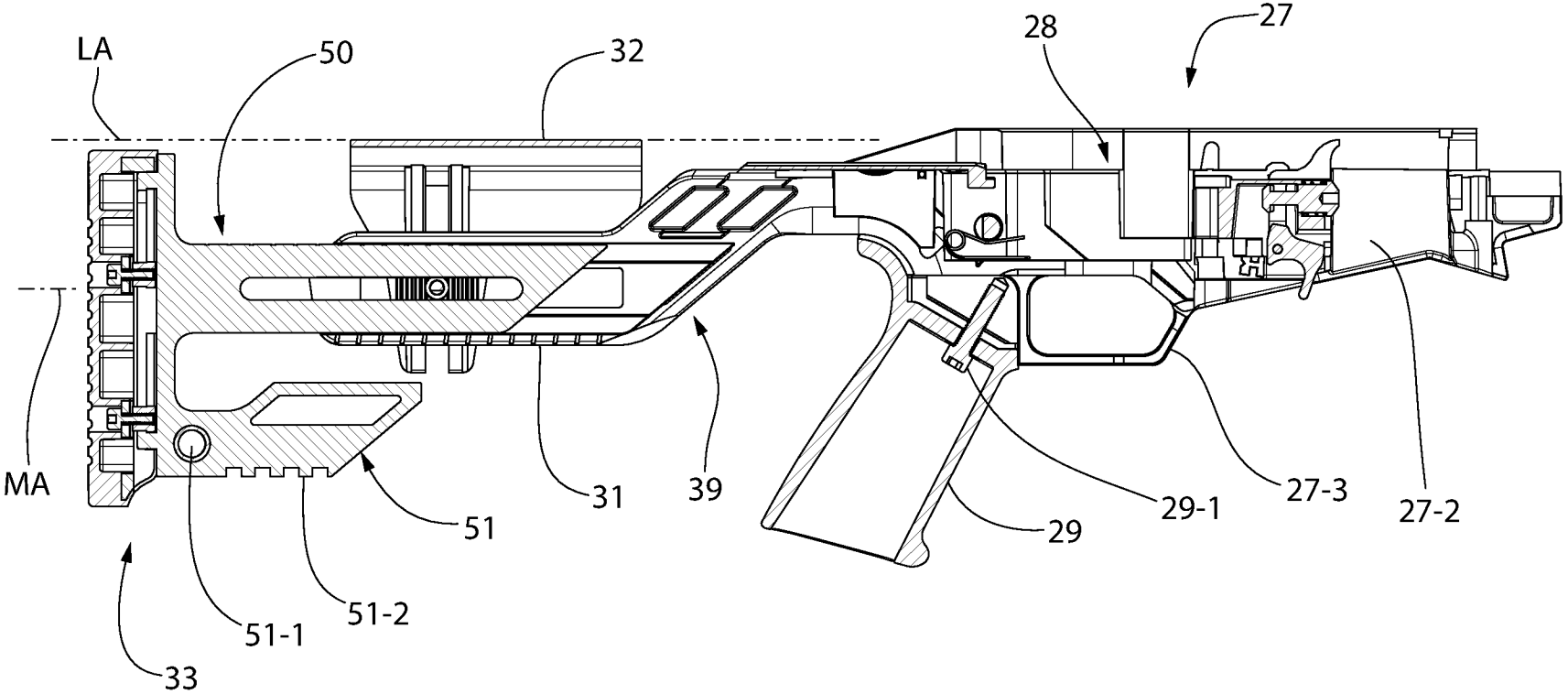
FIG. 10 is a longitudinal cross-sectional view thereof.
Figure 11:
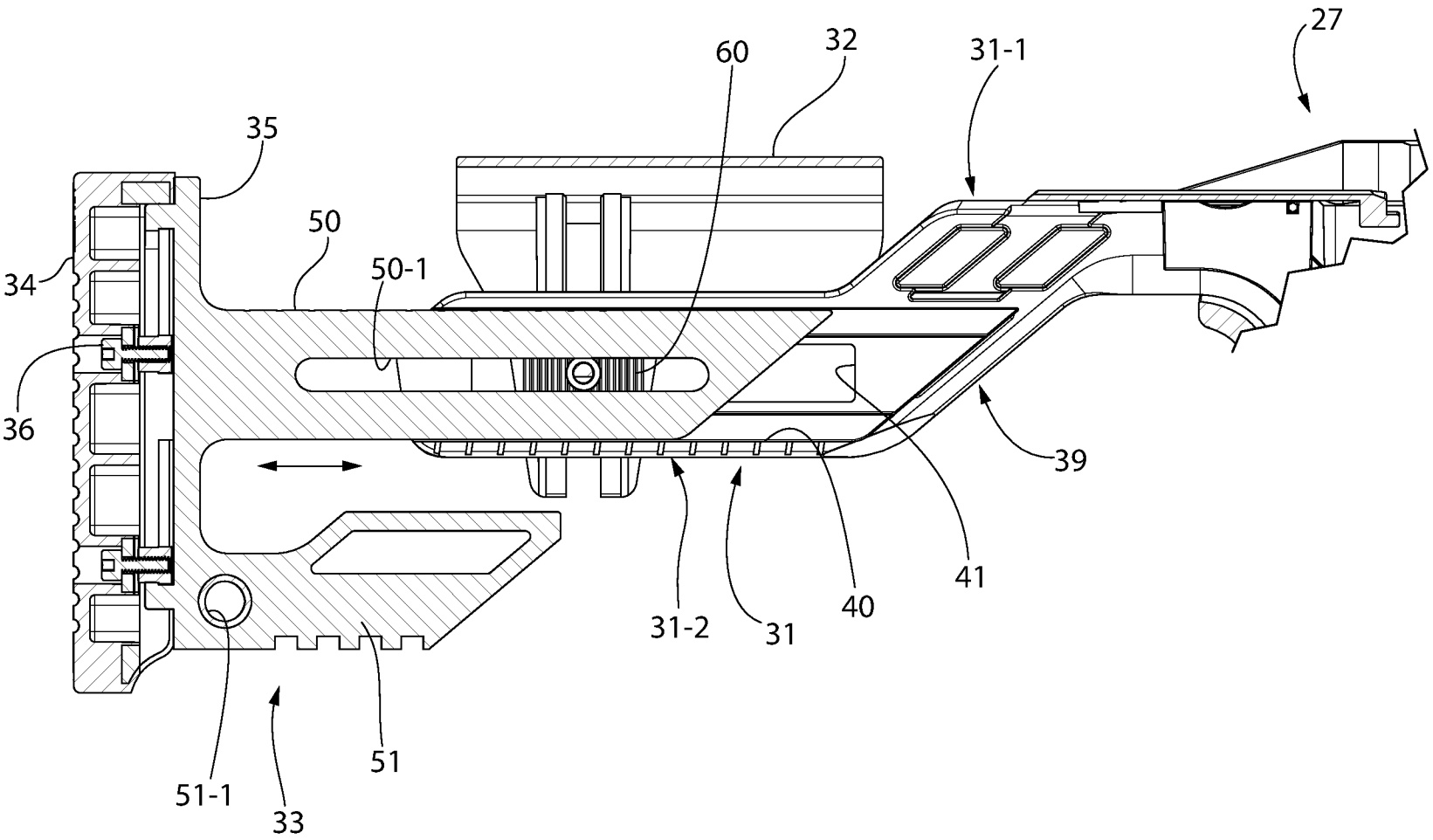
FIG. 11 is an enlarged detail of the rear end portion of the stock from FIG. 10.
Figure 12:
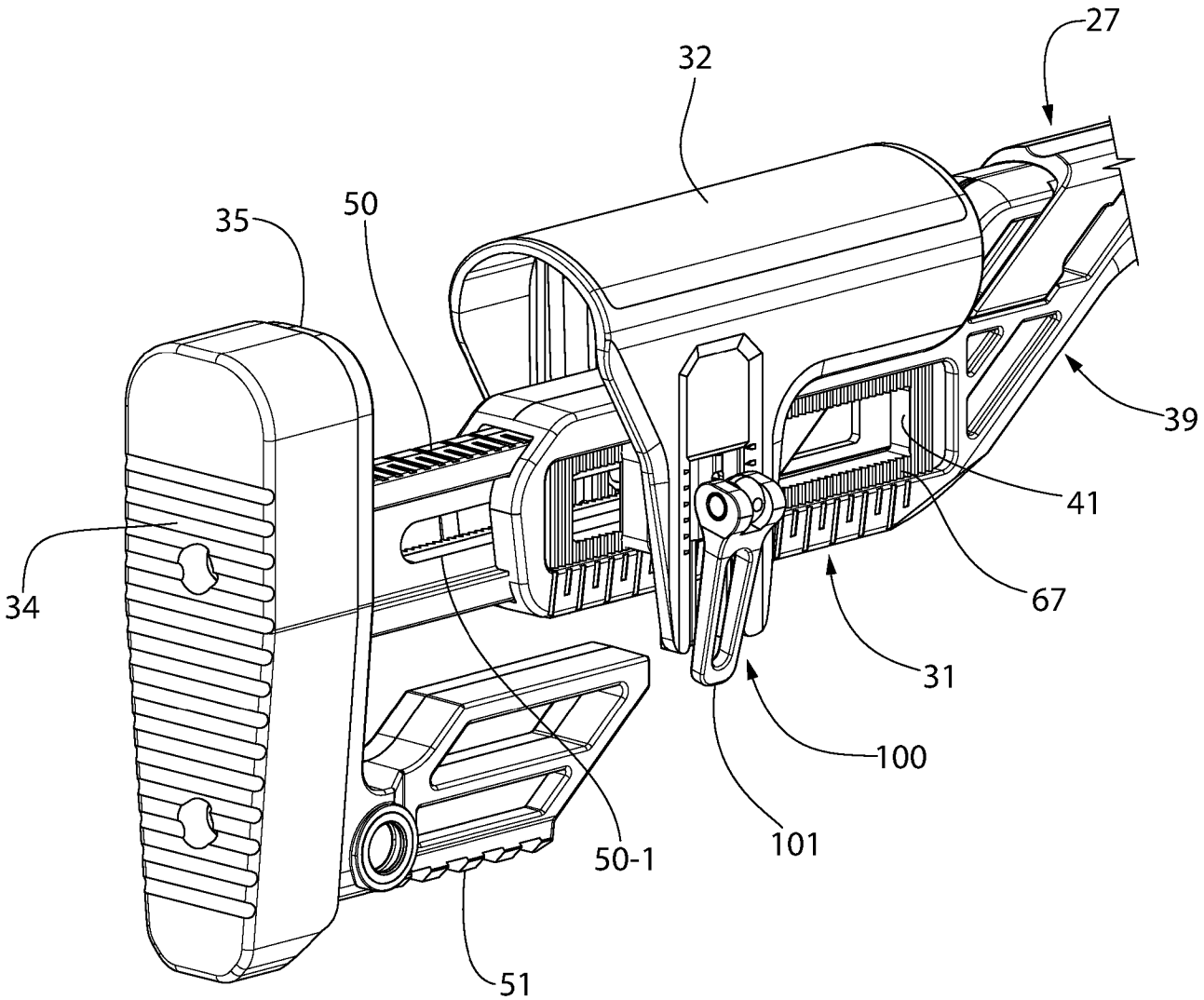
FIG. 12 is a right rear perspective view of the buttstock assembly showing a locking mechanism in a first locked position.
Figure 13:
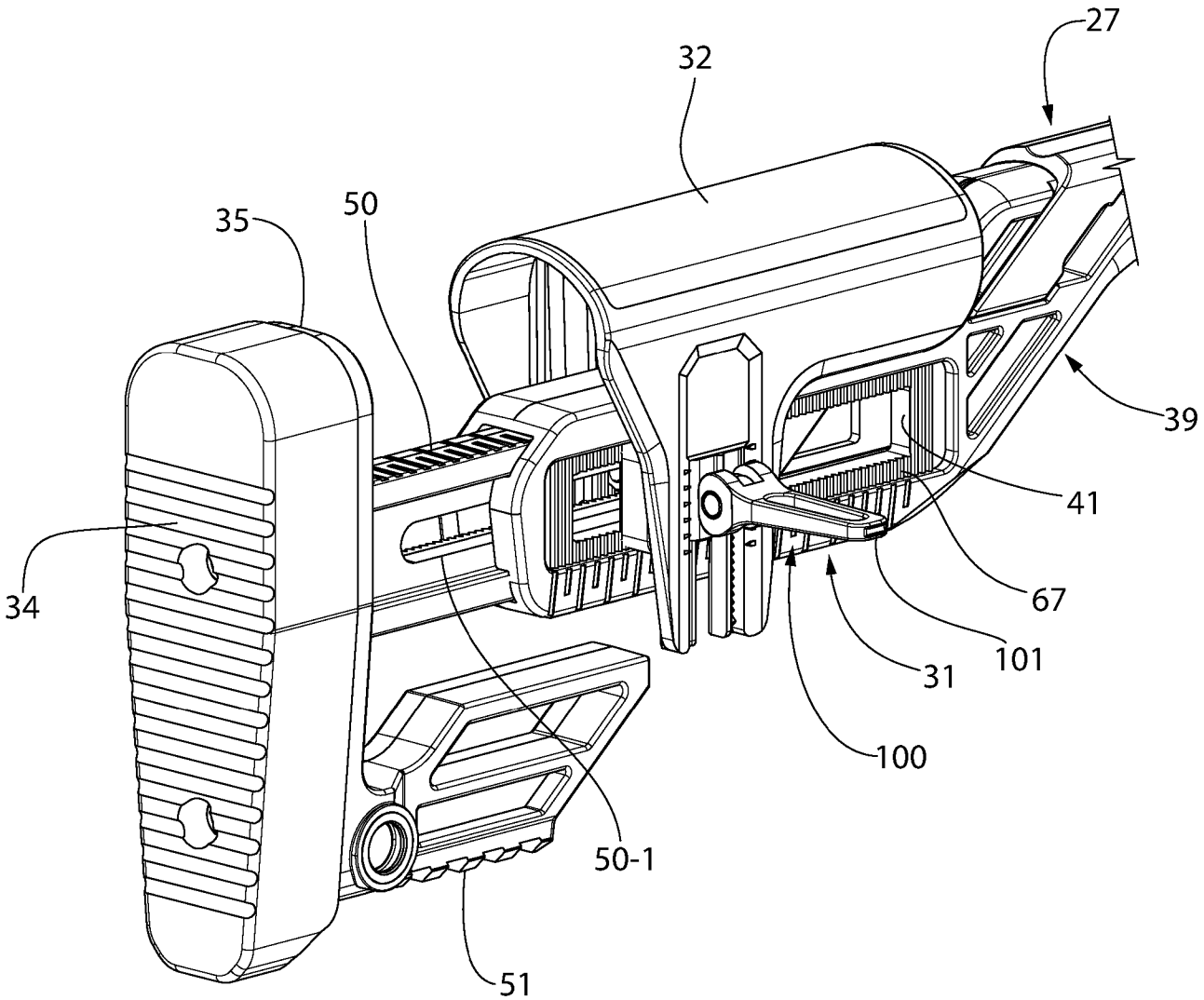
FIG. 13 is a right rear perspective view thereof showing the locking mechanism in an unlocked position.
Figure 14:
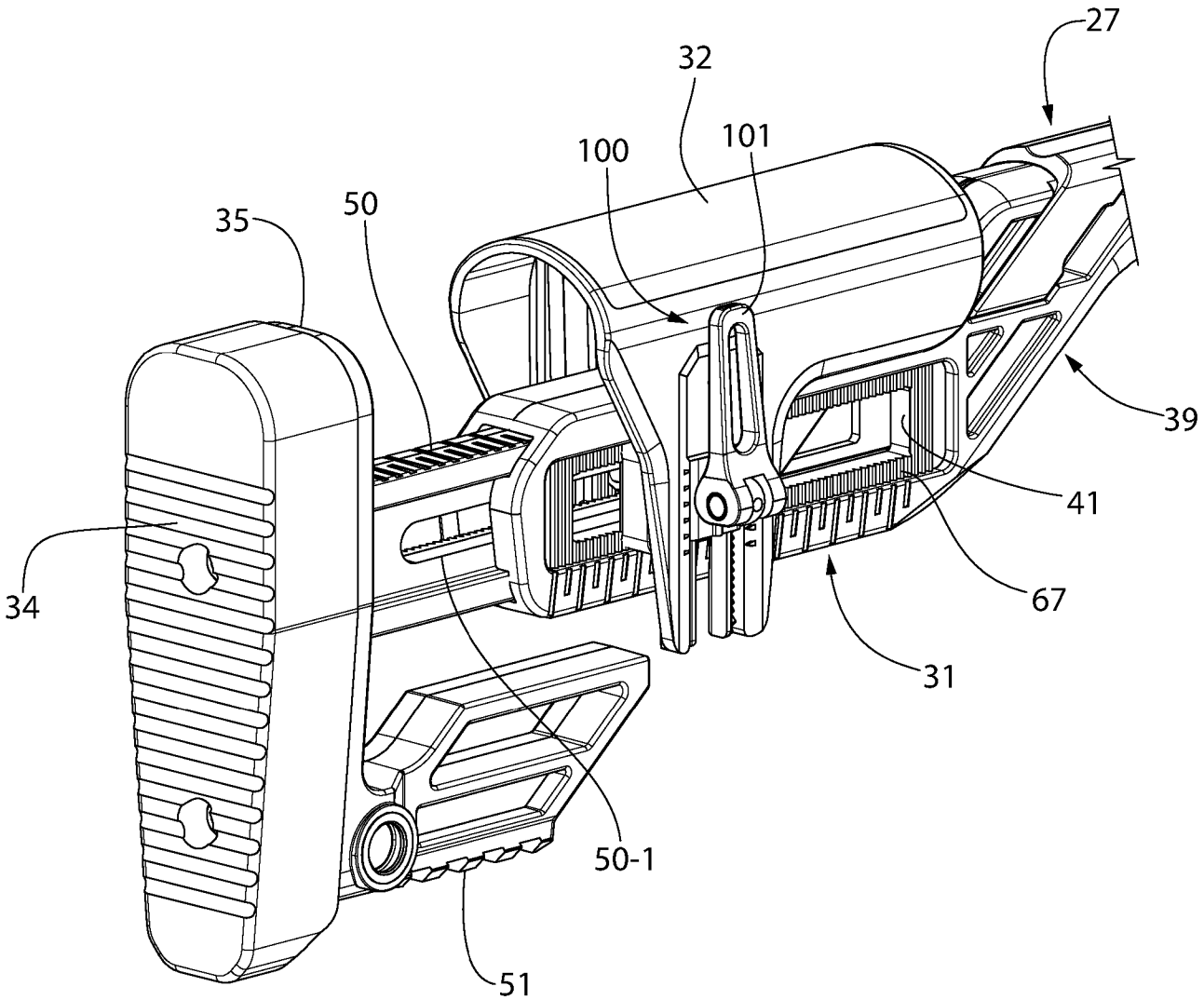
FIG. 14 is a right rear perspective view thereof showing the locking mechanism in a second locked position.
Figure 15:
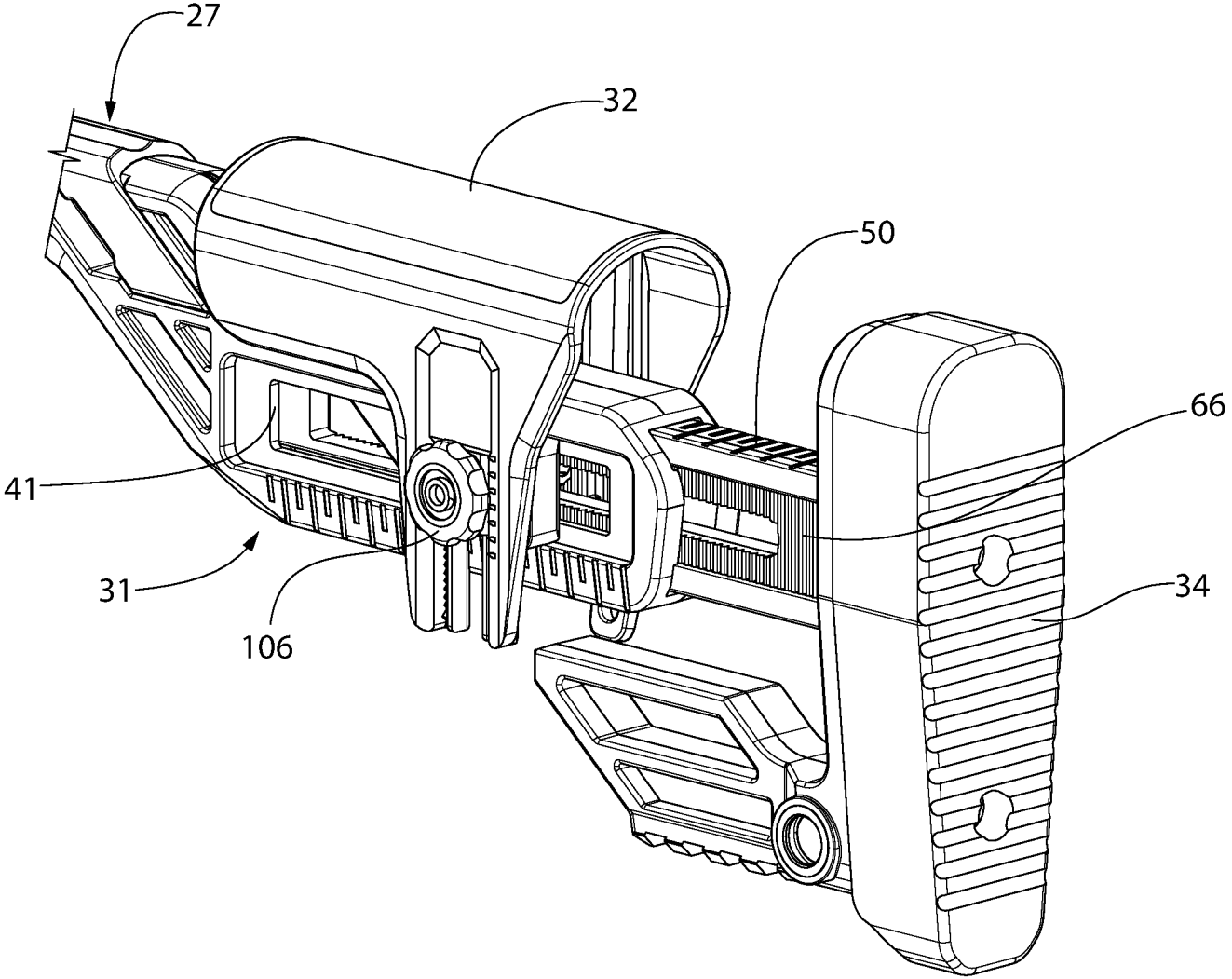
FIG. 15 is a left rear perspective view thereof.

The features and benefits of the invention are illustrated and described herein by reference to exemplary embodiments. This description of exemplary embodiments is intended to be read in connection with the accompanying drawings, which are to be considered part of the entire written description. Accordingly, the disclosure expressly should not be limited to such exemplary embodiments illustrating some possible non-limiting combination of features that may exist alone or in other combinations of features.

In the description of embodiments disclosed herein, any reference to direction or orientation is merely intended for convenience of description and is not intended in any way to limit the scope of the present invention. Relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise.

The term "action" which may be mentioned is used herein in its conventional sense in the firearm art as meaning the mechanism that loads and ejects shells into/from the firearm and opens and closes the breech (i.e. the area in the receiver between an openable/closeable breech face on the front of the bolt and the rear face of the barrel chamber).

Referring initially to FIGS. 1-16, a firearm 20 in the form of a rifle is shown including a stock 20 having a multi-adjustable buttstock assembly 30 according to the present disclosure. Firearm 20 may be any type of long gun, including without limitation a rifle or a shotgun. In one non-limiting example illustrated, the firearm 20 may be a manually operated bolt action rifle. More particularly in one embodiment, the rifle may be a bolt action rimfire rifle. The stock 20 however may be used with centerfire rifles in some embodiments. Accordingly, the stock 20 is not limited in its possible applications.

The bolt action firearm 20 generally includes a receiver 21, a trigger actuated fire control assembly 22 mounted in the receiver and operable to discharge the firearm, a barrel 23 supported by the receiver, optionally a handguard 24 enclosing and circumscribing at least part of the length of the barrel, and stock 26. Stock 26 supports the receiver and fire control assembly in one embodiment. The barrel 23 includes an open front muzzle end 23*a* and an open rear breech end 23*b* (obscured beneath the handguard) coupled to a front end 21*a* of the receiver 21 in any suitable manner. Handguard 24 may similarly be coupled to a front end of the receiver and/or other portions of the firearm.

The firearm 20 defines a longitudinal axis LA and axial direction coinciding with the centerline of the barrel 23 and its longitudinal bore formed therein between the muzzle and breech ends 23*a*, 23*b* that defines a projectile pathway in a known manner.

The receiver 21 supports an axially movable bolt 25 (seen through the receiver's cartridge ejection port in FIG. 1). Bolt 25 may include a laterally extending bolt handle 25*a* for selectively forming a closed or open breech. The bolt 25 is manually and slideably moveable forward/rearward in an axially extending internal cavity of receiver 21 and includes a firing pin (not shown) for detonating a chambered cartridge in the rear breech end 23*b* of the barrel 23 that defines the chamber; all of which is well understood by those skilled in the art without further elaboration.

In one embodiment, stock 26 includes a forward mid-stock 27 and a rearward adjustable buttstock assembly 30 slideably mounted to the mid-stock. The mid-stock 27 may be considered to define an axially elongated one-piece unitary chassis which supports the receiver 21 and adjustable buttstock assembly 30. The buttstock assembly 30 in turn comprises an adjustable butt pad assembly 33 and cheek rest 32. Mid-stock 27 comprises a main body 27-1 defining a longitudinally-extending and upwardly open receiver-bedding cavity 28 for mounting the receiver 21 thereto and for housing the trigger-actuated fire control mechanism 22. The receiver may be partially received within cavity 28, wherein the upper portion of the receiver remains exposed and the lower portion is nested within the cavity in typical fashion. Any suitable method may be used to mount the receiver 21 to the main body 27-1 of the mid-stock, such as for example fasteners (e.g. screws, bolts, pins, etc.). A downwardly open magazine well 27-2 is defined by the main body 27-1 of the mid-stock for receiving a magazine well insert and ammunition magazine therein (not shown). In one embodiment, mid-stock 27 may also comprise a downwardly extending pistol grip 29 in some embodiments to facilitate handling the firearm. Pistol grip 29 may be integrally formed with the mid-stock as a unitary structural part thereof, or alternatively may be a discrete separate part fastened to the mid-stock such as via one or more fasteners 29-1 (see, e.g. FIG. 10). Mid-stock 27 further includes a trigger guard 27-3 in one embodiment.

In one embodiment, mid-stock 27 may be formed of a non-metallic like a polymeric material such as glass reinforced nylon or other plastics. Mid-stock 27 may therefore be made by a suitable plastic molding process, such as injection molding. Other non-metallic and metallic materials may be used for the mid-stock.

Mid-stock 27 further comprises a rearwardly and axially extending mounting extension 31 for mounting buttstock assembly 30 thereto in an adjustable manner. Mounting extension 31 is an axially elongated structure having a length in one embodiment which forms greater than 30% of the total length of the mid-stock 27, and in some embodiments greater than 40% of the mid-stock total length. Mounting extension 31 has a greater length than its height or width. In a preferred but non-limiting embodiment, the mounting extension 31 may be formed as an integral unitary structural part of the monolithic mid-stock main body 27-1, which facilitates formation of the entire chassis with mounting extension by injection molding in a single mold for economies of fabrication. The mounting extension 31 provides a common support and mounting platform for the adjustable butt pad assembly 33 and cheek rest 32, as further described herein.

In one embodiment, the rear mounting extension 31 comprises an upper section 31-1 extending rearward from and contiguous with the main body 27-1 of the mid-stock 27, and a lower section 31-2 which defines a terminal rear end 31-3 of the mounting extension. Each of the upper section 31-1 and lower section 31-2 are generally straight and extend axially parallel to longitudinal axis LA. Upper and lower sections 31-1, 31-2 lie in two different horizontal planes and are vertically offset from one another. An angled transition section 39 may be formed between the upper and lower sections giving the mounting extension 31 a somewhat angular S-shaped configuration in one embodiment as shown. The foregoing arrangement locates the lower section 31-2 of mounting extension 31 below the upper section 31-1, main body 27-1 of mid-stock 27, and longitudinal axis LA. The lower section 31-1 defines a horizontal buttstock assembly mounting axis MA, which is therefore vertically offset from the horizontal centerline of the main body and longitudinal axis LA. When the butt pad of the buttstock assembly 30 is positioned against a user's shoulder, the offset advantageously elevates the barrel to the proper height in alignment with the user's line of sight for aiming.

In one configuration, the chassis mounting extension 31 may have a generally rectangular overall configuration in transverse cross section. The rear end 31-3 of the mounting extension 31 may optionally have rounded corners. Mounting extension 31 defines an axially elongated and rearwardly open internal longitudinal cavity 40 for mounting buttstock assembly 30 thereto. Each lateral side 42 of mounting extension 31 may comprise an outwardly open window 41. Windows 41 may be axially elongated in one embodiment as shown and extend for a majority of the length of mounting extension 31. The windows 41 facilitate mounting of the slideable locking system used to mount the butt pad assembly 33 and cheek rest 32 to the mounting extension, as further described herein.

Buttstock assembly 30 comprised of the butt pad assembly 33 and cheek rest 32 may have a variety of configurations; one non-limiting example being shown in the figures. In one non-limiting embodiment, as illustrated, the buttstock assembly 30 may be a non-folding type structure.

Figure 16:
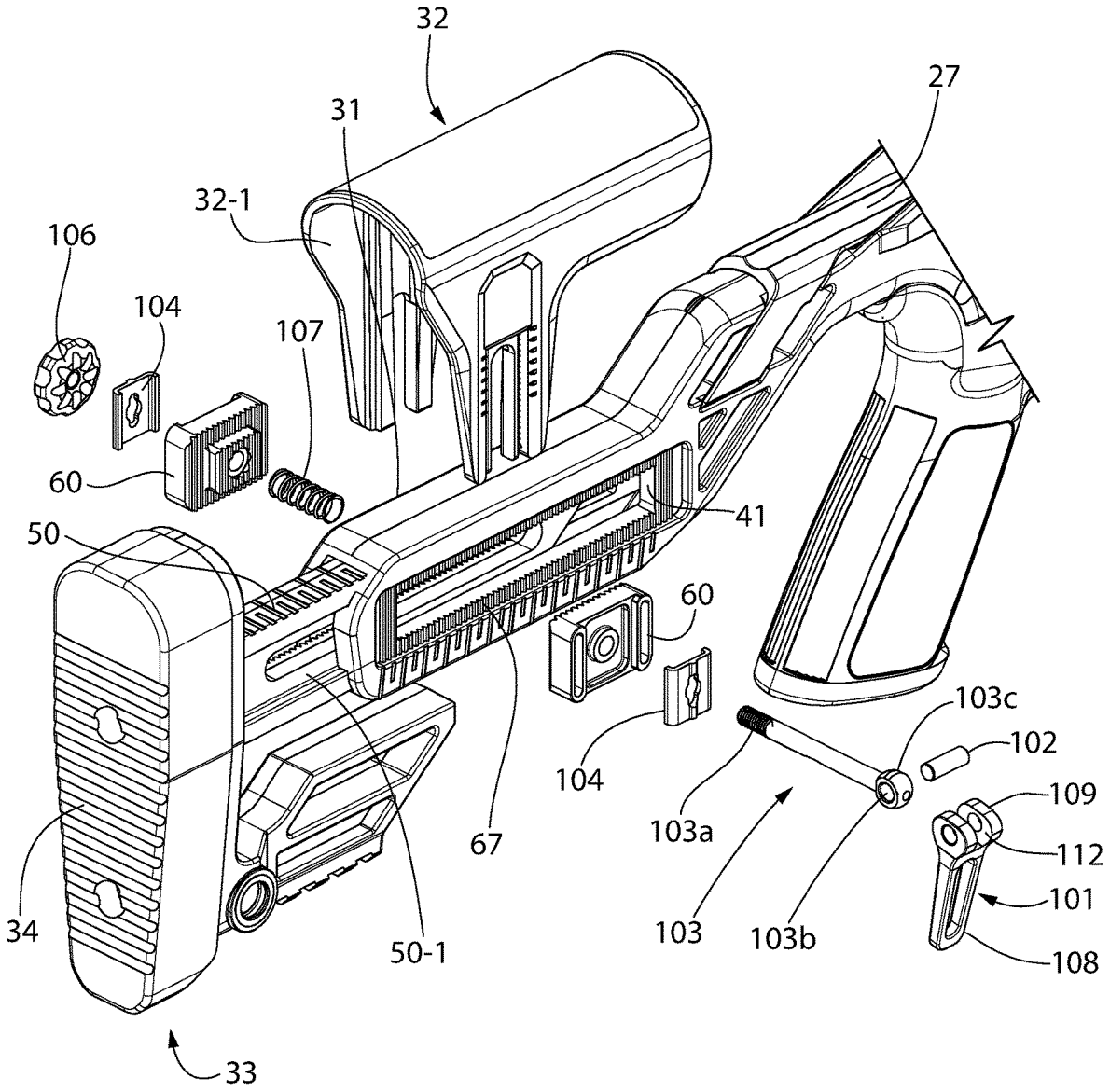
FIG. 16 is an exploded right rear perspective view of the buttstock assembly and locking mechanism.
Figure 17:
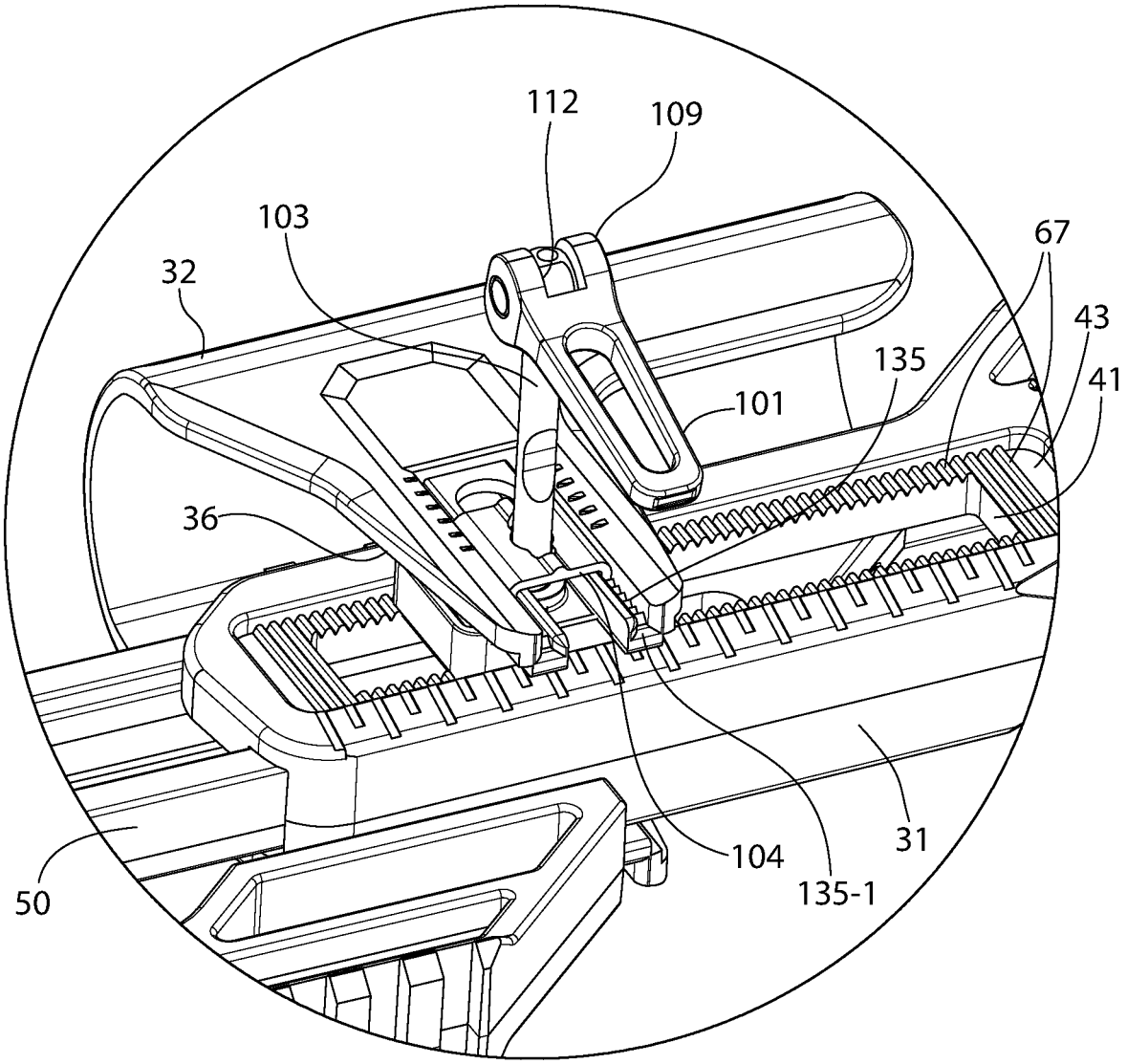
FIG. 17 is a right perspective view showing the locking mechanism partially assembled to the buttstock.
Figure 18:
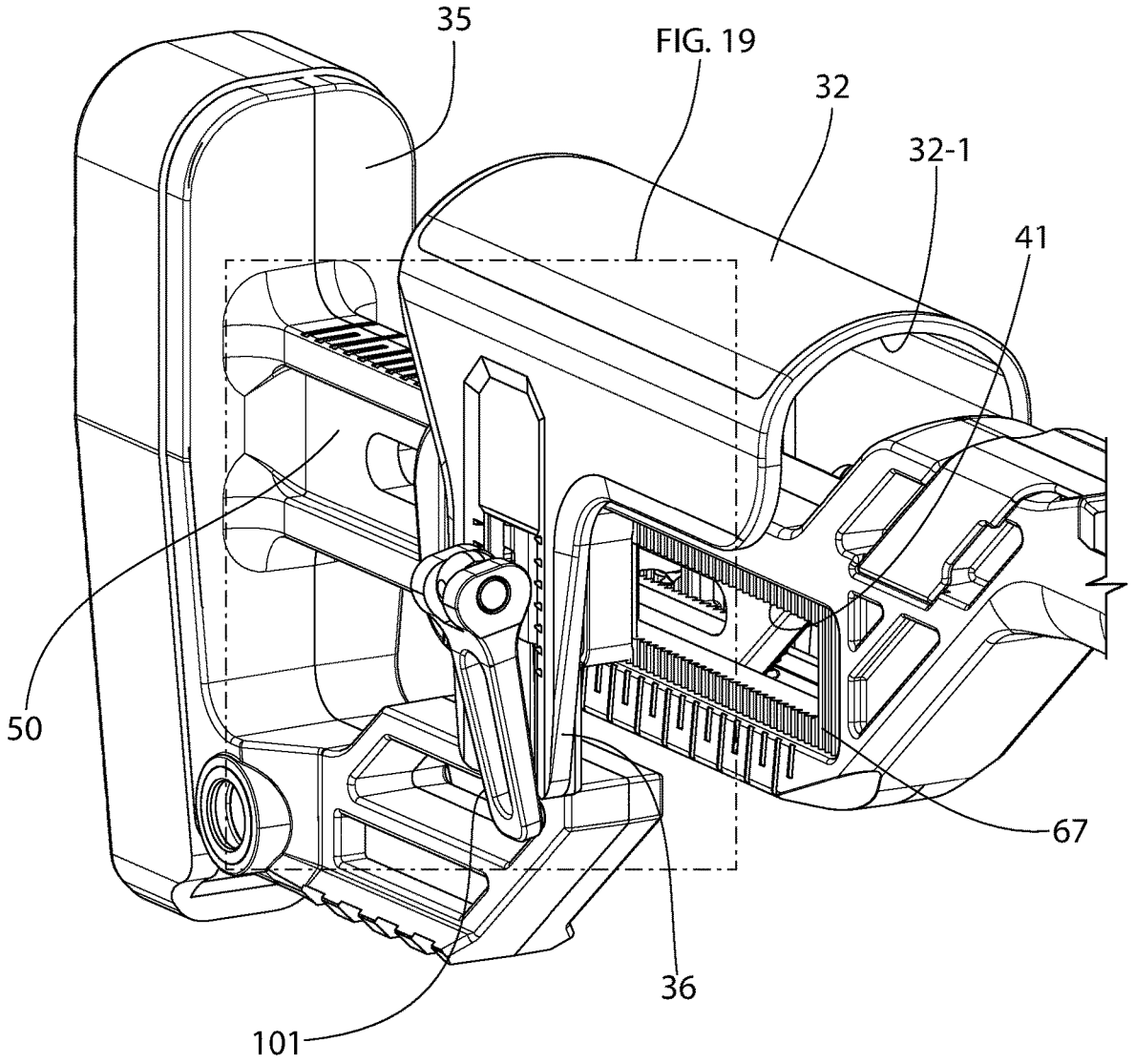
FIG. 18 is a right front perspective view showing the locking mechanism in a lock position with cam lever in a locking position.
Figure 19:
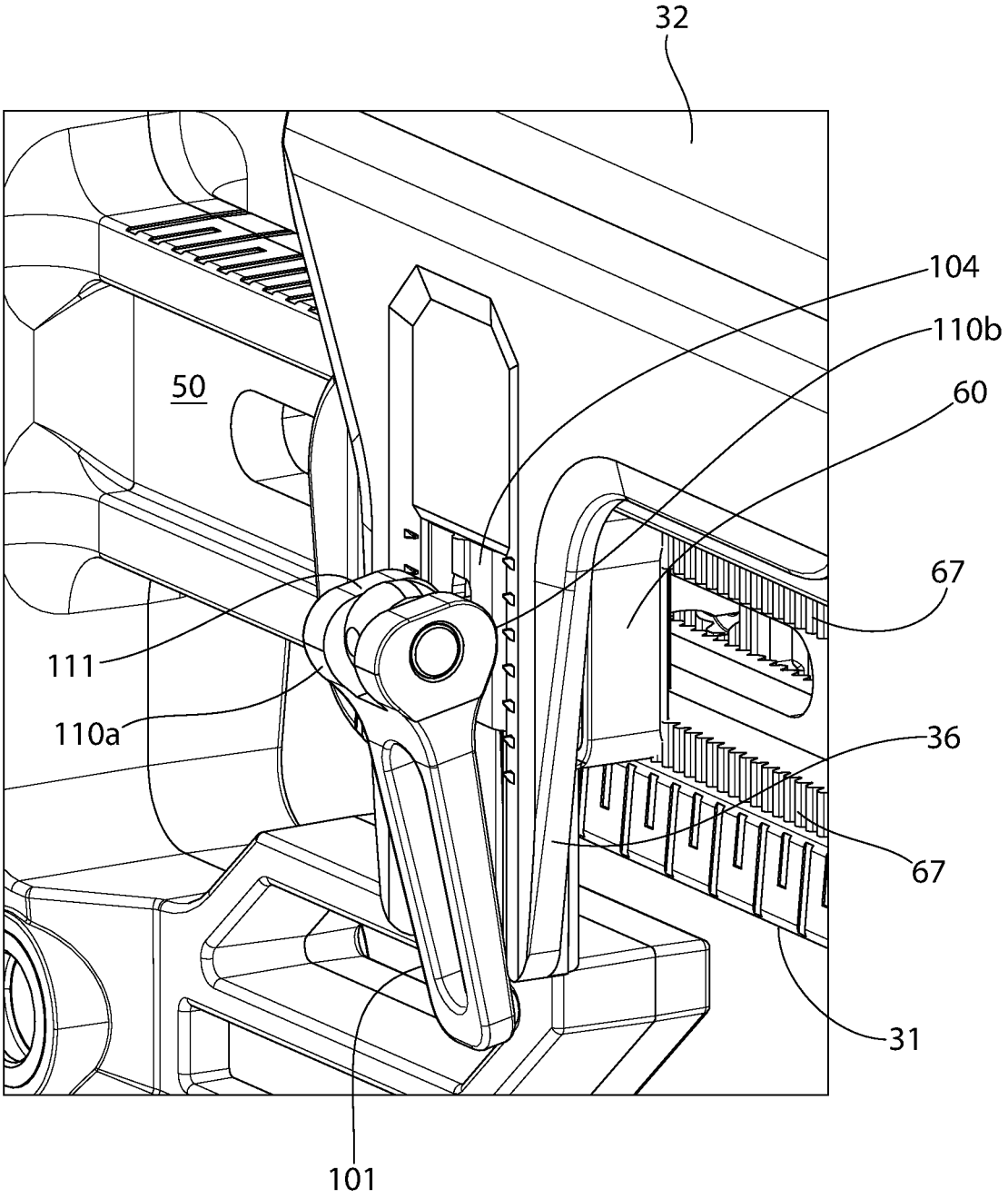
FIG. 19 is an enlarged detail from FIG. 18.
Figure 20:
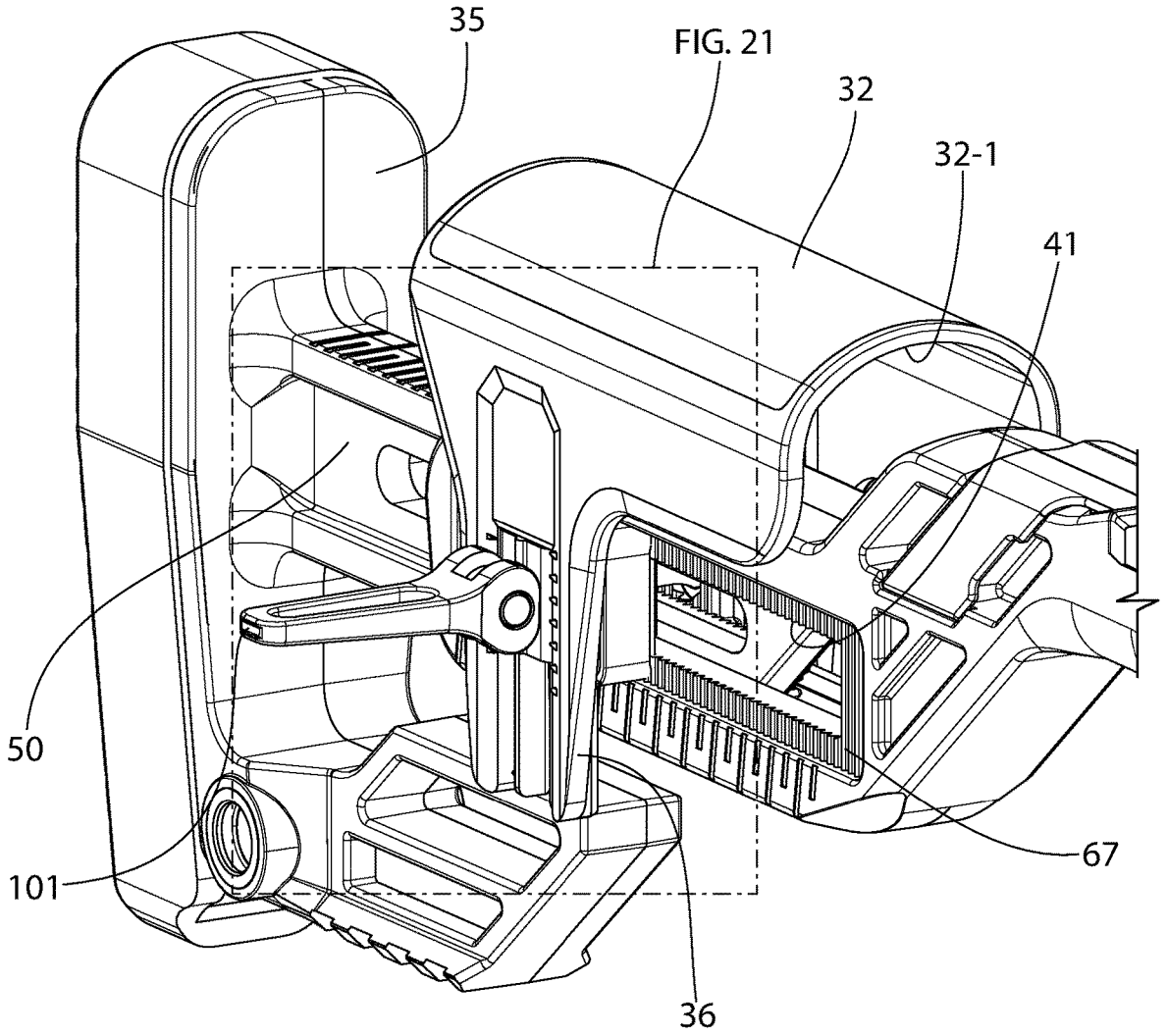
FIG. 20 is a right front perspective view showing the locking mechanism in a lock position with cam lever in a release position.
Figure 21:
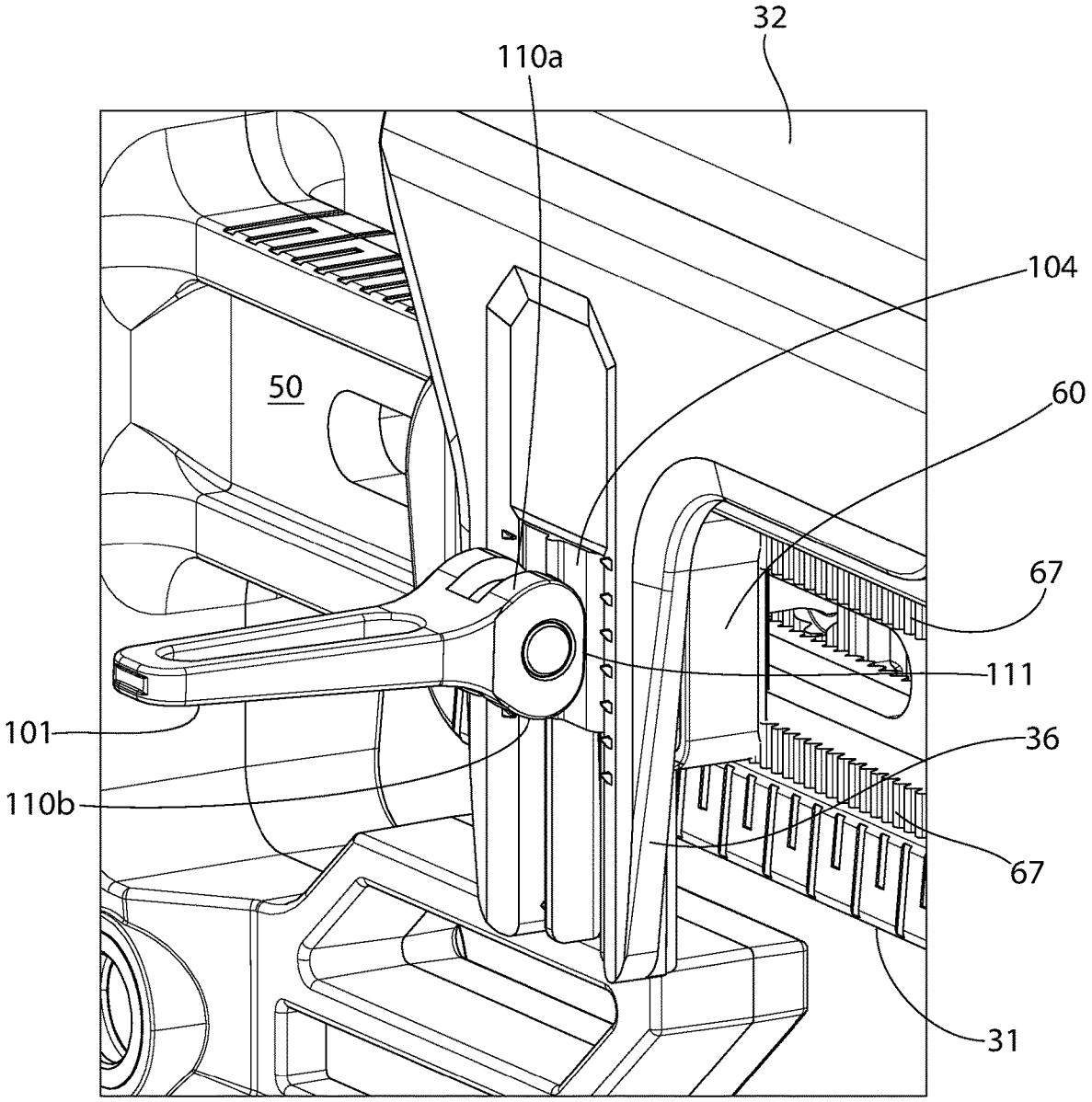
FIG. 21 is an enlarged detail from FIG. 20.
Figure 22:
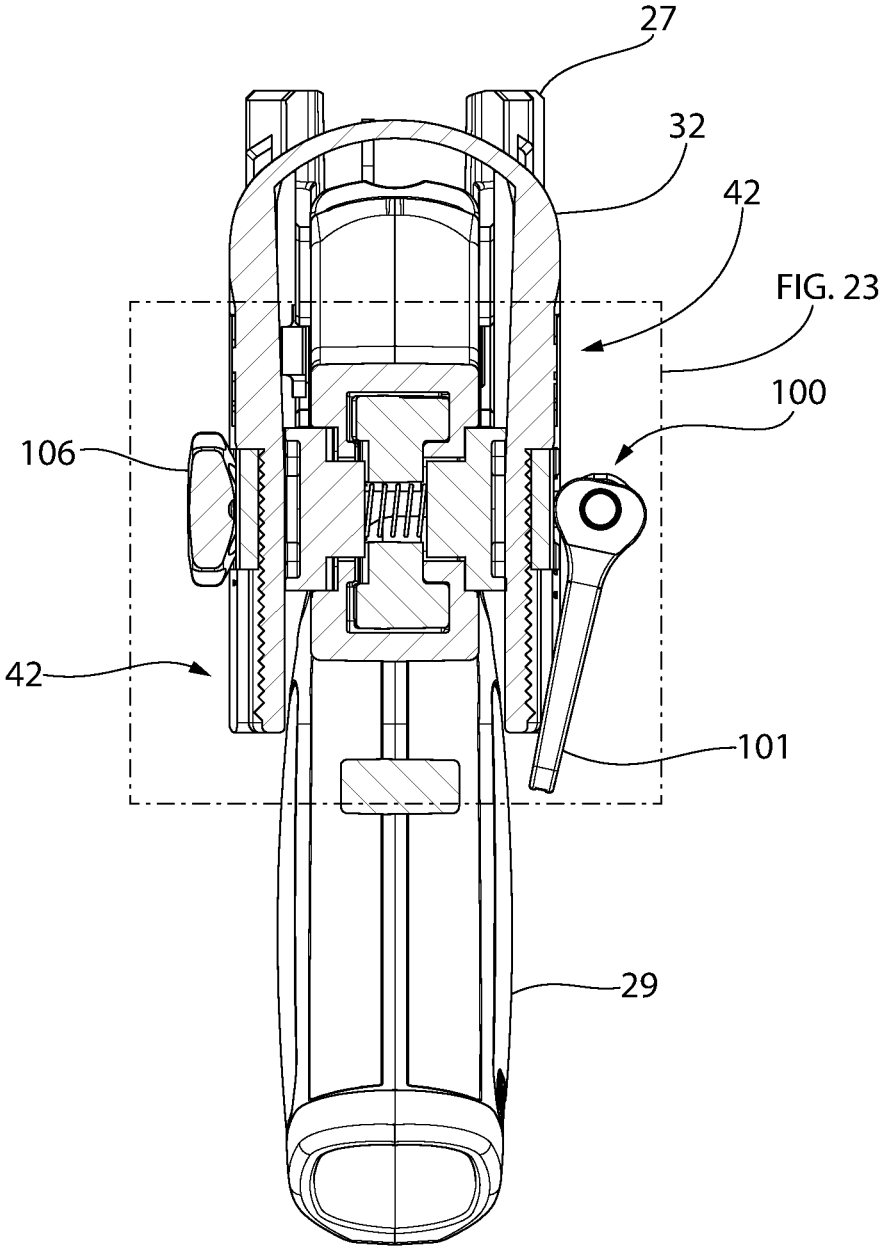
FIG. 22 is a forward-looking rear transverse cross-sectional view of the buttstock assembly showing the locking mechanism in a locked position with cam lever in a locking position.
Figure 23:
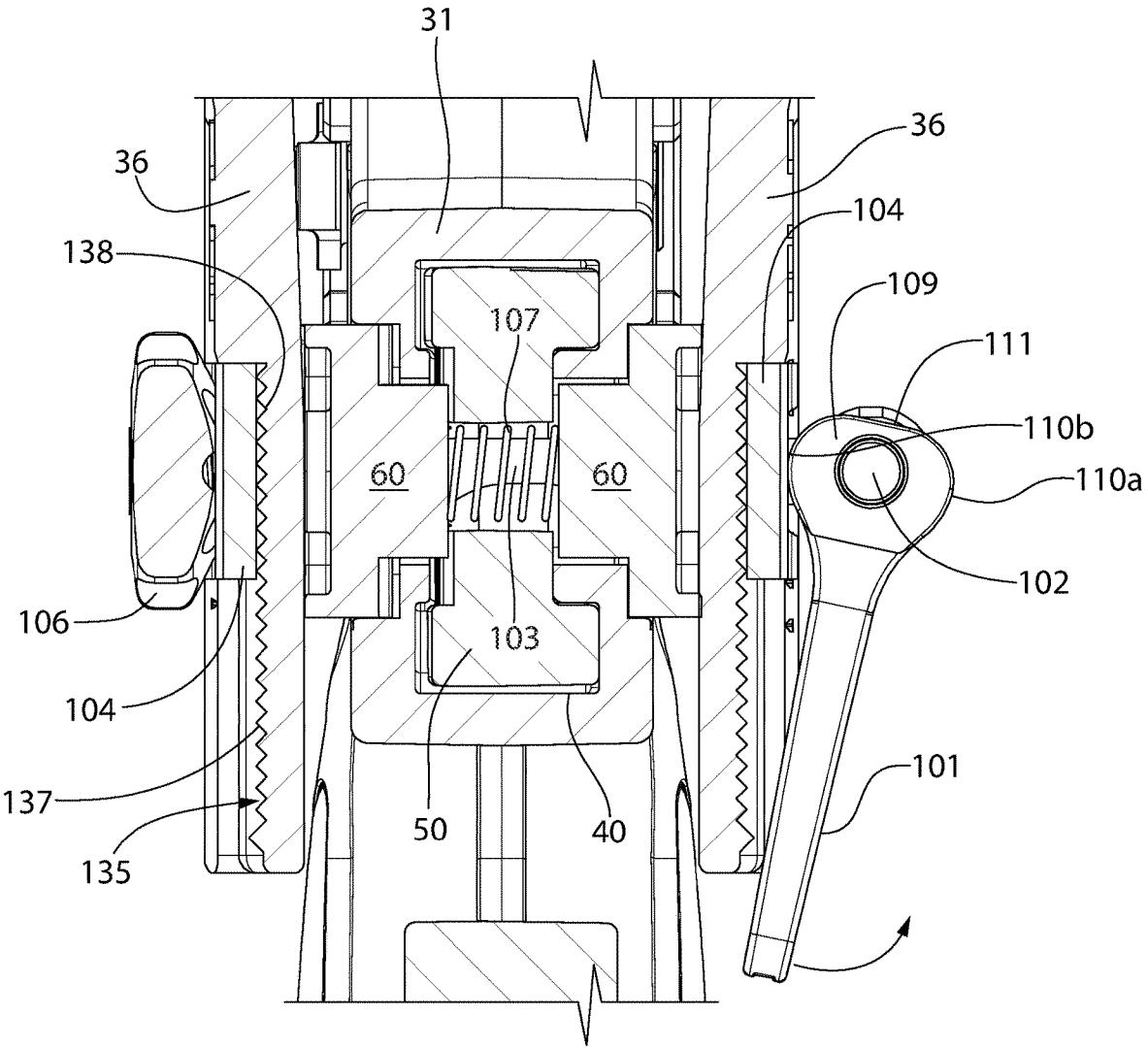
FIG. 23 is an enlarged detail from FIG. 22.
Figure 24:
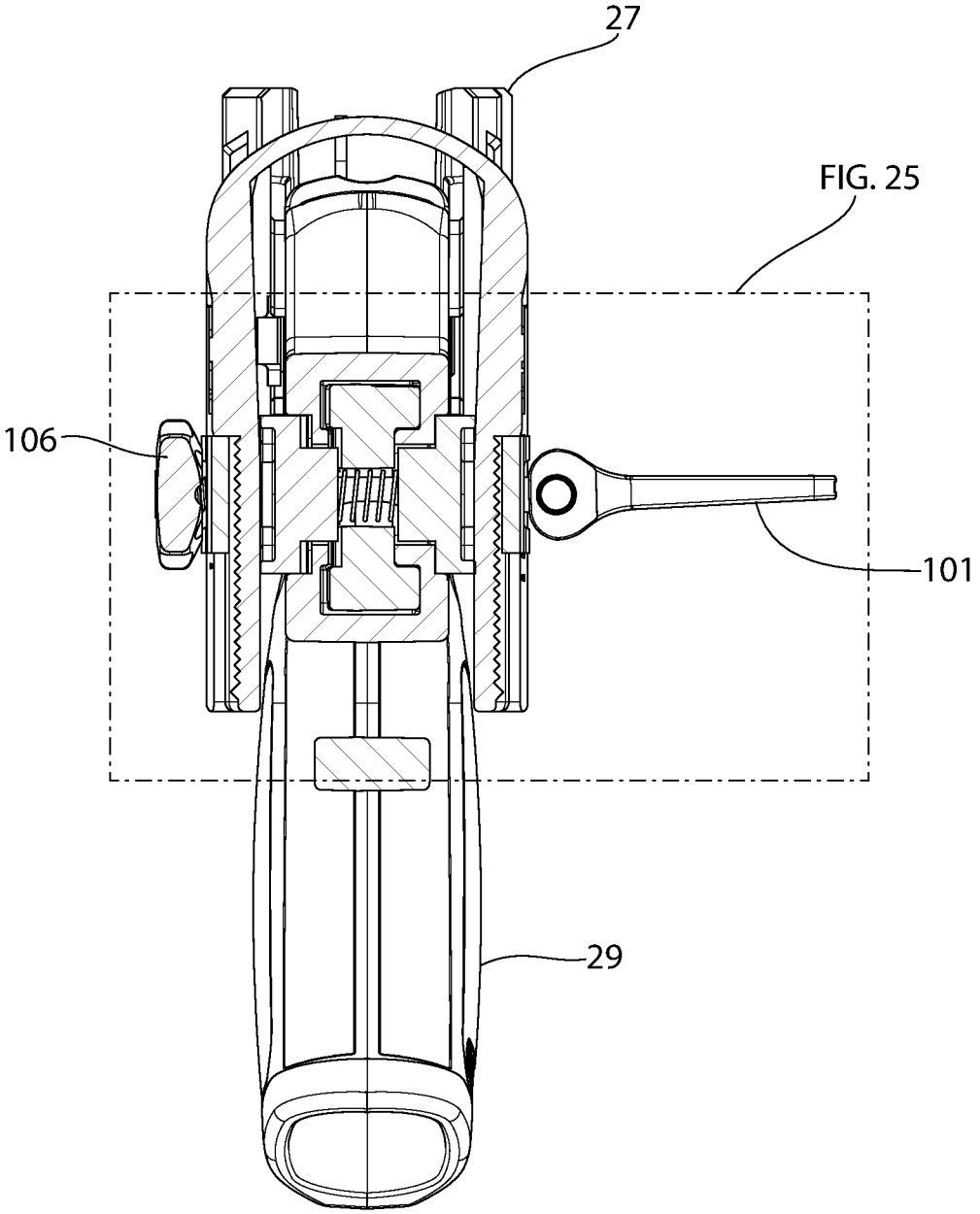
FIG. 24 is a forward-looking rear transverse cross-sectional view of the buttstock assembly showing the locking mechanism in an unlocked position with cam lever in a release position.

The components of the buttstock assembly 30 and locking mechanism are seen in the exploded view of FIG. 16. Buttstock assembly 30 in one implementation may include a vertically and longitudinally/axially adjustable cheek rest 32 and a longitudinally/axially adjustable butt pad assembly 33. Butt pad assembly 33 is configured for placement against the user's shoulder when aiming the firearm held in a ready-to-fire position to acquire a target. The butt pad assembly allows the length of the buttstock (i.e. length of pull) to be adjusted to accommodate different users and preferences. In a preferred but non-limiting embodiment, the buttstock includes both an adjustable cheek rest and butt pad assembly each adjustable via a single adjustment mechanism, as further described herein. In other less preferred but possible satisfactory embodiments, a non-adjustable stationary cheek rest 32 may be provided which is fixedly attached to the rear mounting extension 31 of the chassis.

Referring generally to FIGS. 1-16, butt pad assembly 33 includes a vertically elongated butt or recoil pad 34 attached to a forward recoil pad base plate 35. Recoil pad 34 may be attached to base plate 35 by any suitable method, including without limitation threaded fasteners 36 as shown and/or adhesives, friction or interference fit, interlocking features, etc. The recoil pad base plate 35 may be substantially rigid and vertically elongated in structure to absorb recoil forces generated by firing the firearm 20, which are then transmitted through the base plate to the recoil pad 34 configured to rest against the user's shoulder. Recoil pad base 35 may be made of a metallic or preferably non-metallic material in one embodiment such as a hard plastic to reduce weight. The recoil pad 34 preferably is made of a deformable cushioned energy absorbing material such as without limitation an elastomeric polymer, rubber, closed or open cell foam, memory foam, gel, or combinations of these material and others. Recoil pad 34 in other embodiments may be made of a substantially rigid material such as plastic or other. Accordingly, the invention is not limited by the construction of the butt pad or recoil plate.

It should be noted that various parts of the buttstock assembly described herein may be made of any variety of suitable materials including glass reinforced or non-reinforced polymers, metals, composite materials, fiberglass, wood, and combinations thereof as some non-limiting examples. The material selection will be dictated in part by functional and service conditions as well as weight saving considerations. Accordingly, the invention is not limited by material selection for the butt pad components.

Figure 31:
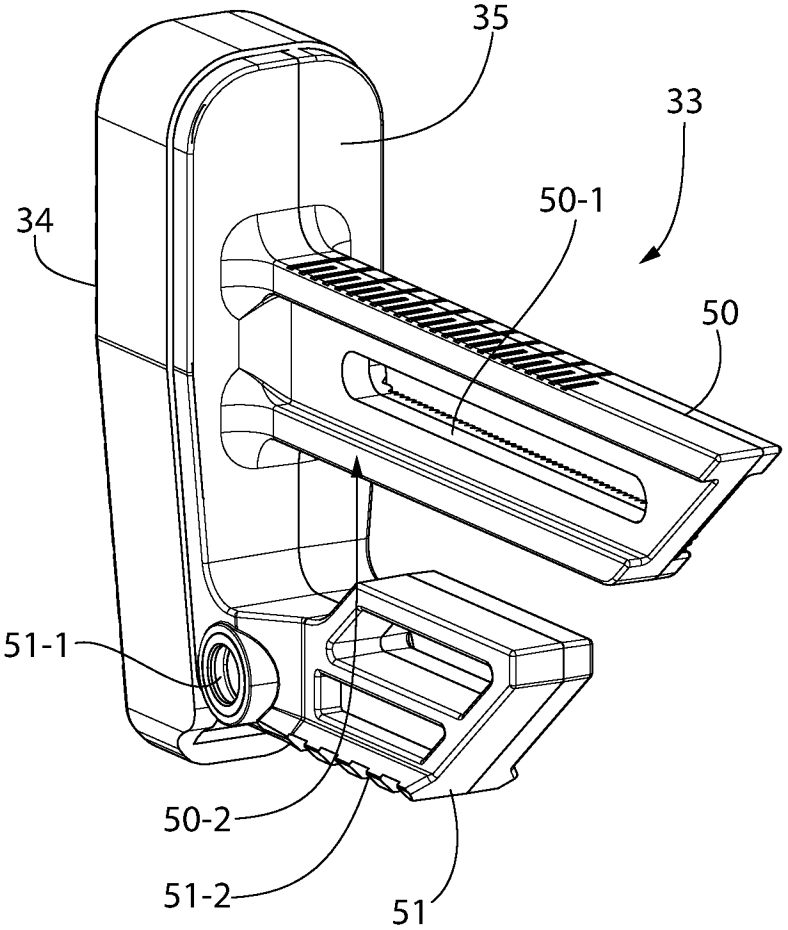
FIG. 31 is a right front perspective view thereof.
Figure 32:
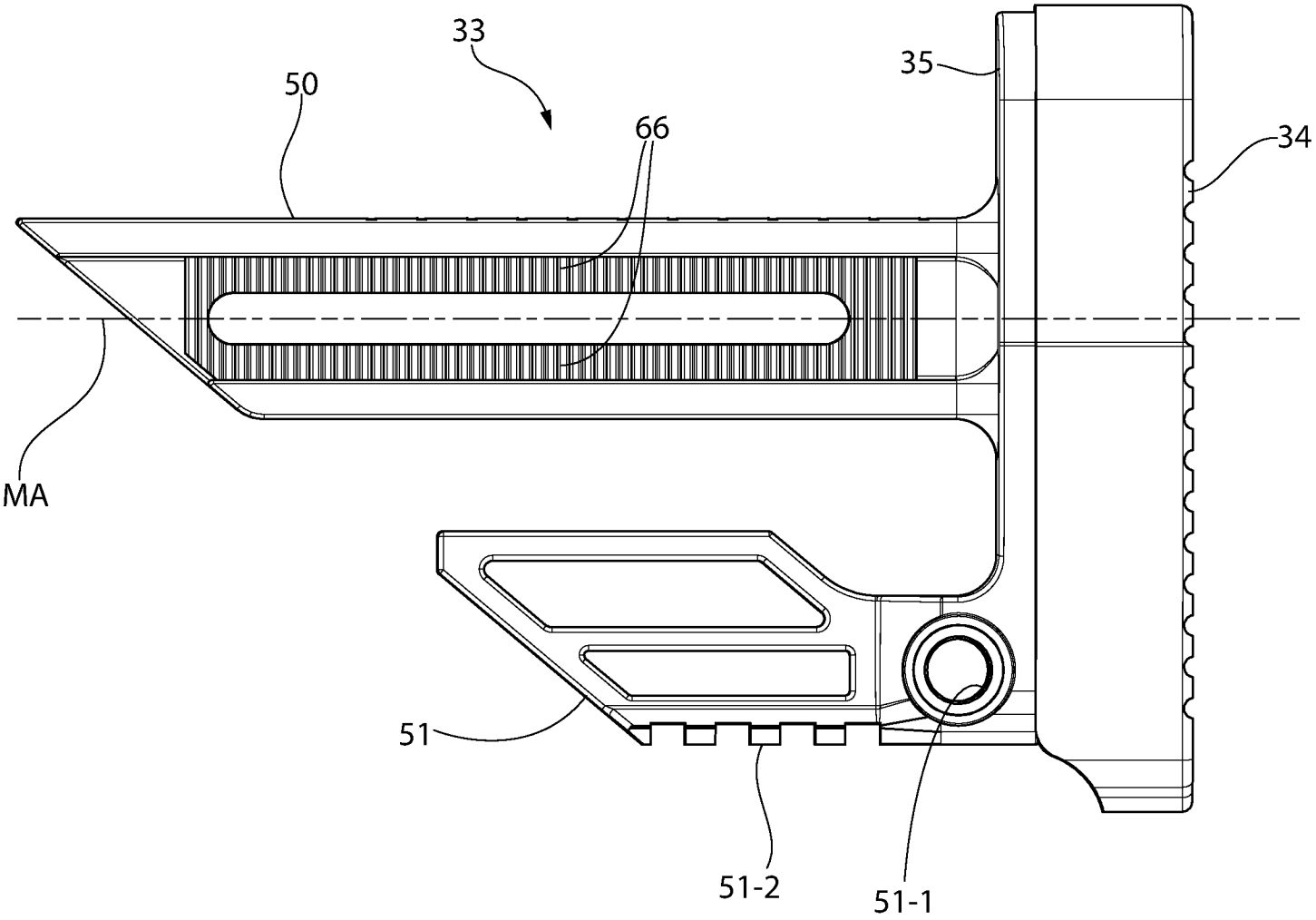
FIG. 32 is a left side view thereof.

The buttstock assembly adjustment and locking features of the adjustable butt pad assembly 33 will now be described with initial reference to FIGS. 10-32. FIGS. 30-32 show the butt pad assembly 33 alone.

Butt pad assembly 33 includes an axial position adjustment feature generally comprised of an upper adjustment rail 50 which allows the length of pull to adjusted per the user's preferences. A lower accessory rail 51 may optionally be provided in some embodiments for mounting various accessories to the buttstock assembly. Accessory rail 51 plays no role in adjusting or locking the length of pull of the butt pad assembly 33. Upper adjustment and lower accessory rails 50, 51 extend or protrude longitudinally and axially forward from the butt pad assembly 33 (i.e. parallel to longitudinal axis LA). Rails 50, 51 are rigidly and fixedly attached mounted to the recoil pad base plate 35 which prevents relative movement of the rails with respect to the butt pad assembly. Any suitable means or combination of means may be used to couple the rails 50, 51 to the recoil pad base plate 35, including without limitation threaded or non-threaded fasteners, pins, adhesives, welding, interference fits, interlocking features, etc.

In one preferred embodiment, the axially elongated rails 50, 51 are integrally formed as a unitary structural part of the monolithic recoil pad base plate body, which may be formed of molded plastic in an example construction. The rails 50, 51, base plate 35, and butt pad 34 provide a separate structurally self-supporting assembly which is then coupled to the mounting extension 31 of the stock chassis.

The adjustment and accessory rails 50, 51 may be spaced vertically apart and arranged parallel to each other and longitudinal axis LA. The rails 50, 51 may lie in the same vertical plane along the centerline of the firearm 20 which includes the longitudinal axis LA. The upper adjustment rail 50 may be located between the top heel and bottom toe of the butt pad 34, but more proximate to the heel. Accordingly, upper adjustment rail 50 is oriented parallel to longitudinal axis LA but spaced below the axis. The lower accessory rail 51 is disposed more proximate the bottom toe of the butt pad 34.

The upper adjustment rail 50 and lower accessory rail 51 may have any suitable transverse cross-sectional shape and length. The accessory rail may be shorter in length than the adjustment rail in one embodiment. In the non-limiting embodiment illustrated, the rails 50, 51 may have different cross-sectional shapes and side profiles as shown. Accessory rail 51 may include a laterally open through hole 51-1 and a section of accessory rail 51-2 in one to facilitate mounting accessories. Adjustment rail 50 includes an axially elongated longitudinal slot 50-1 for passage of the coupling shaft 103 of the cam lever assembly 100 therethrough. The longitudinally-extending slot allows the adjustment rail 50 to slide forward and rearward in the longitudinal cavity 40 of the chassis rear mounting extension 31.

Figure 27:
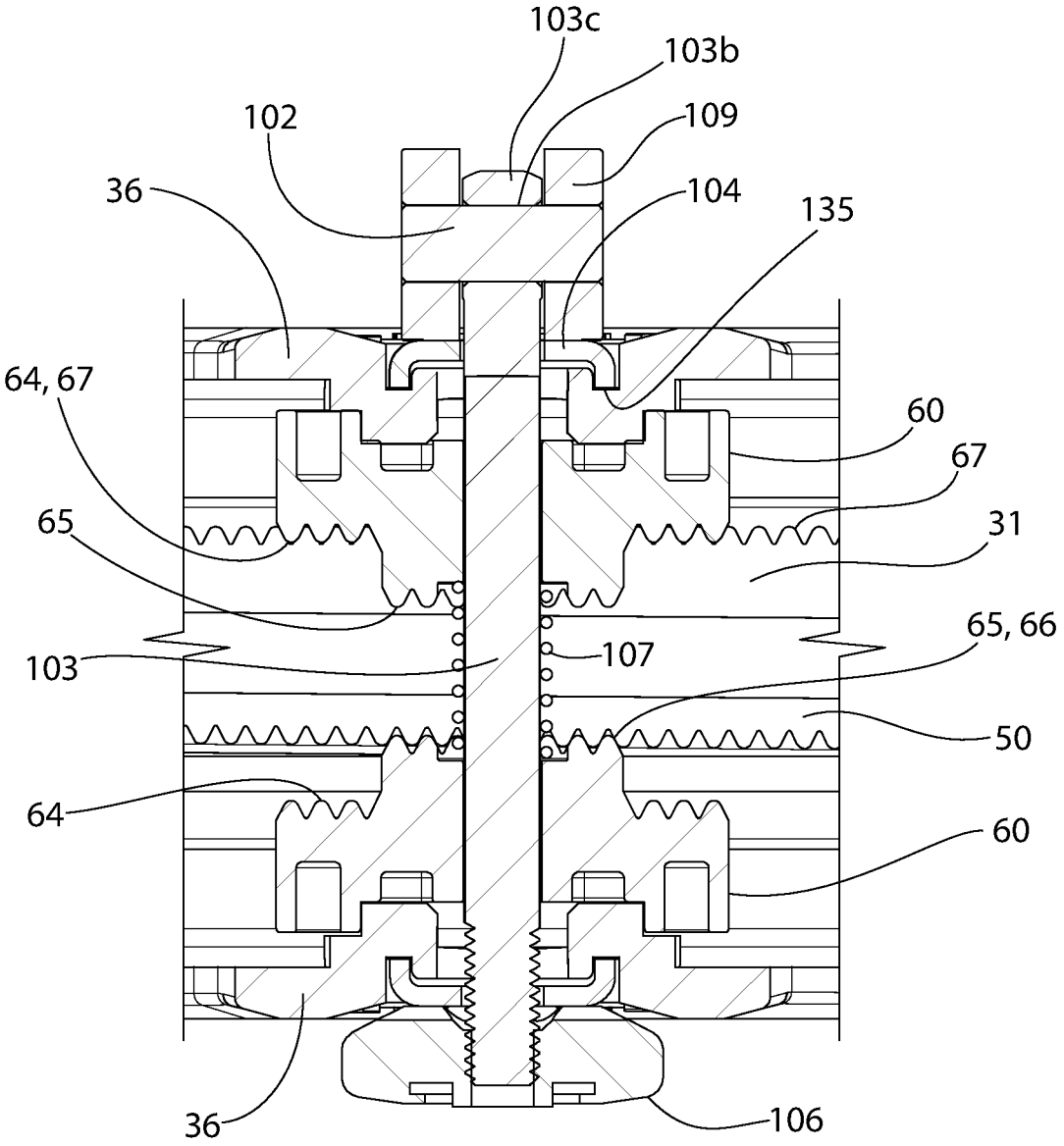
FIG. 27 is an enlarged detail from FIG. 26.
Figure 28:
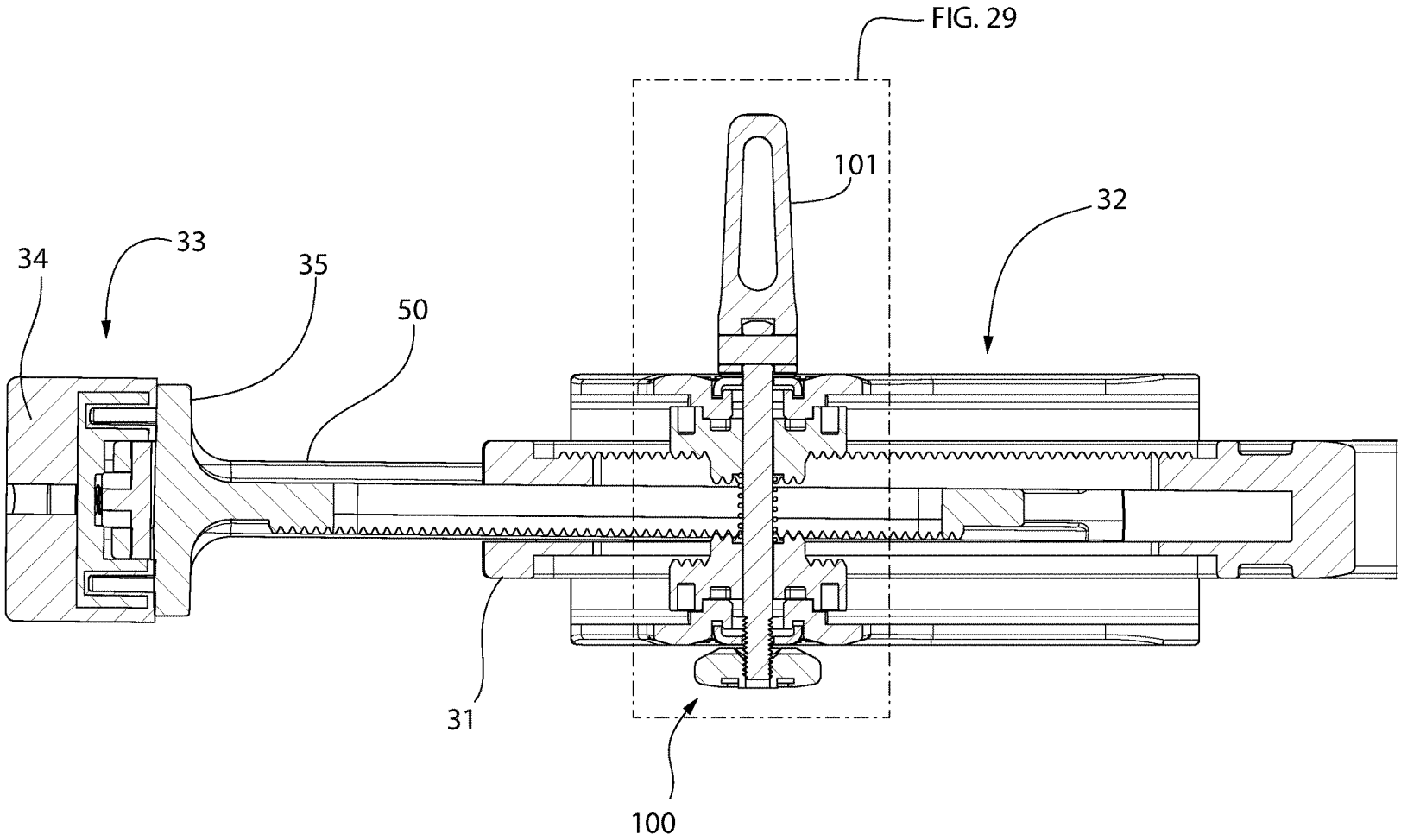
FIG. 28 is a top longitudinal cross-sectional view of the buttstock assembly showing the locking mechanism in an unlocked position with cam lever in a release position.
Figure 33:
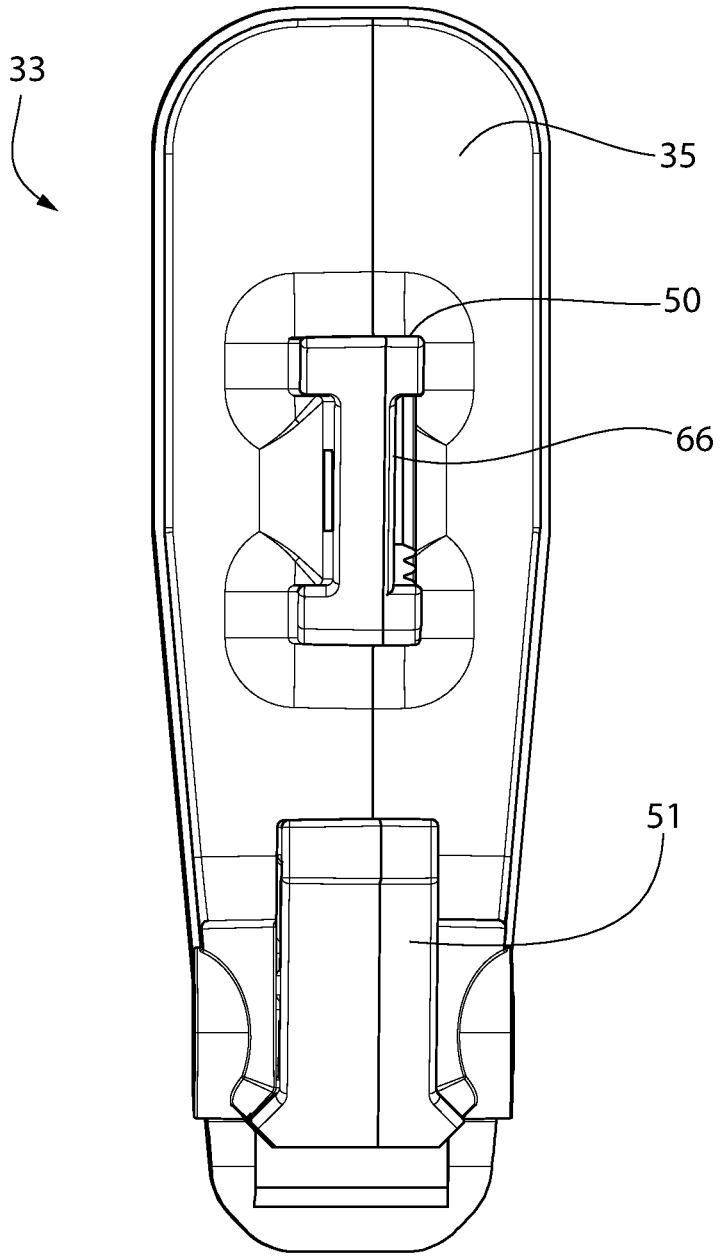
FIG. 33 is front view thereof showing an I-shaped adjustment rail of the butt pad assembly.
Figure 34:
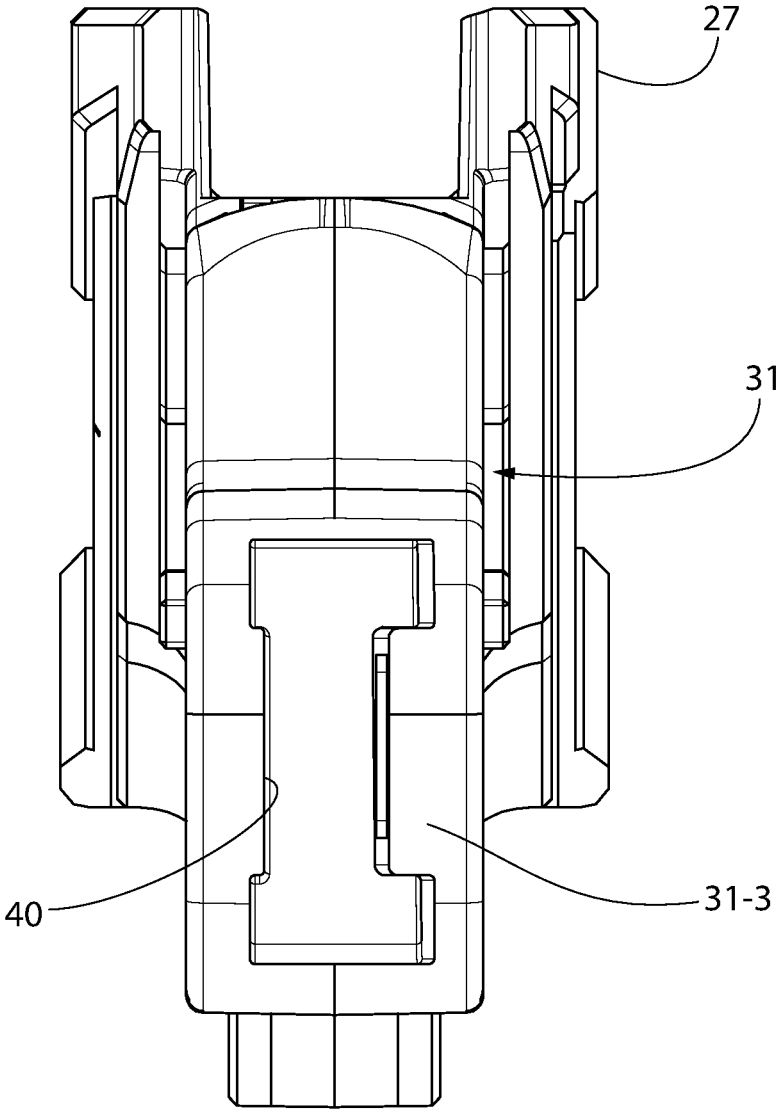
FIG. 34 is a rear end view of the stock chassis showing the rear end of a mounting extension for coupling the butt pad assembly and cheek rest thereto.
Figure 35:
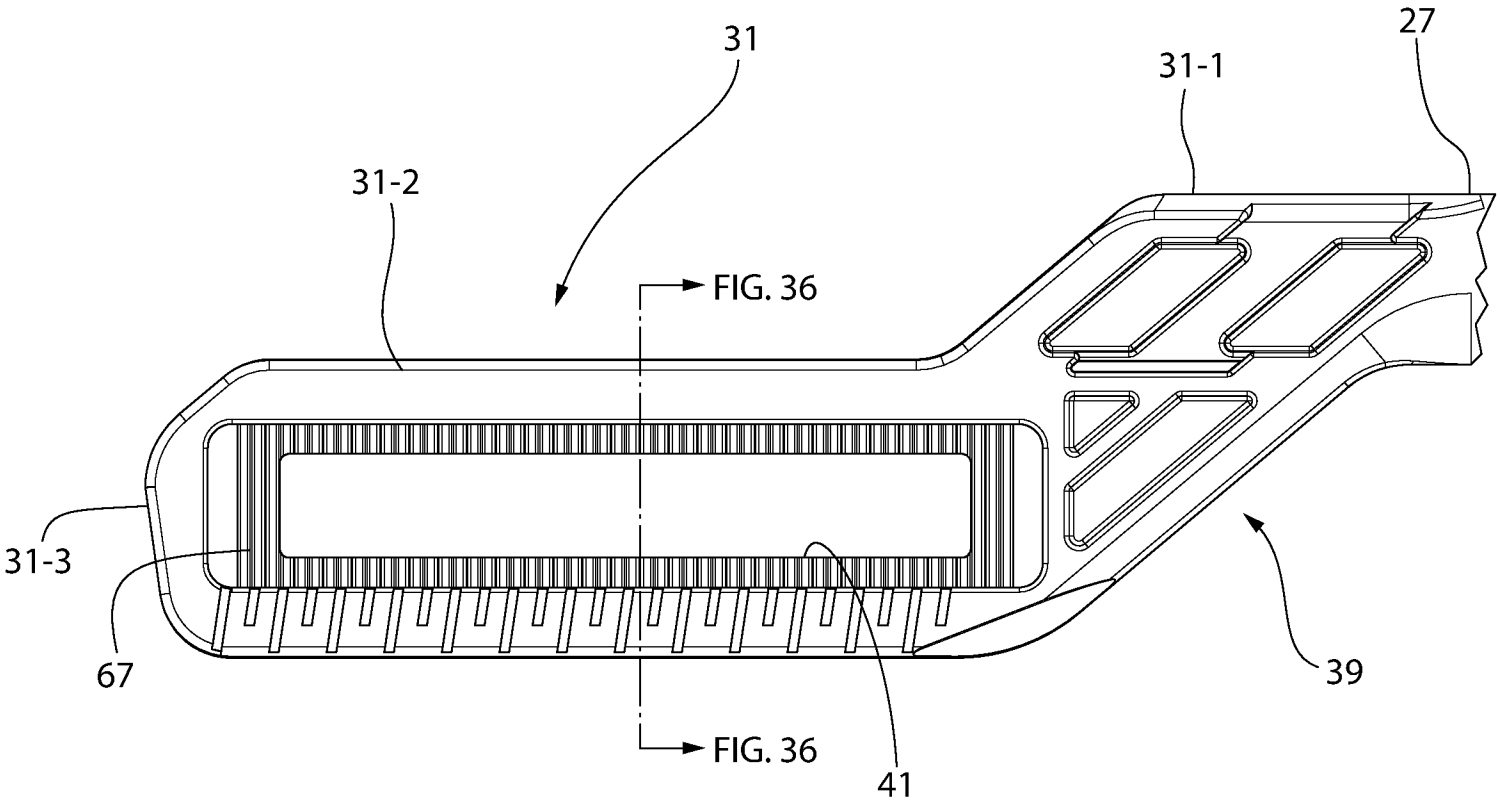
FIG. 35 is a right side view of the mounting extension of the stock.
Figure 36:
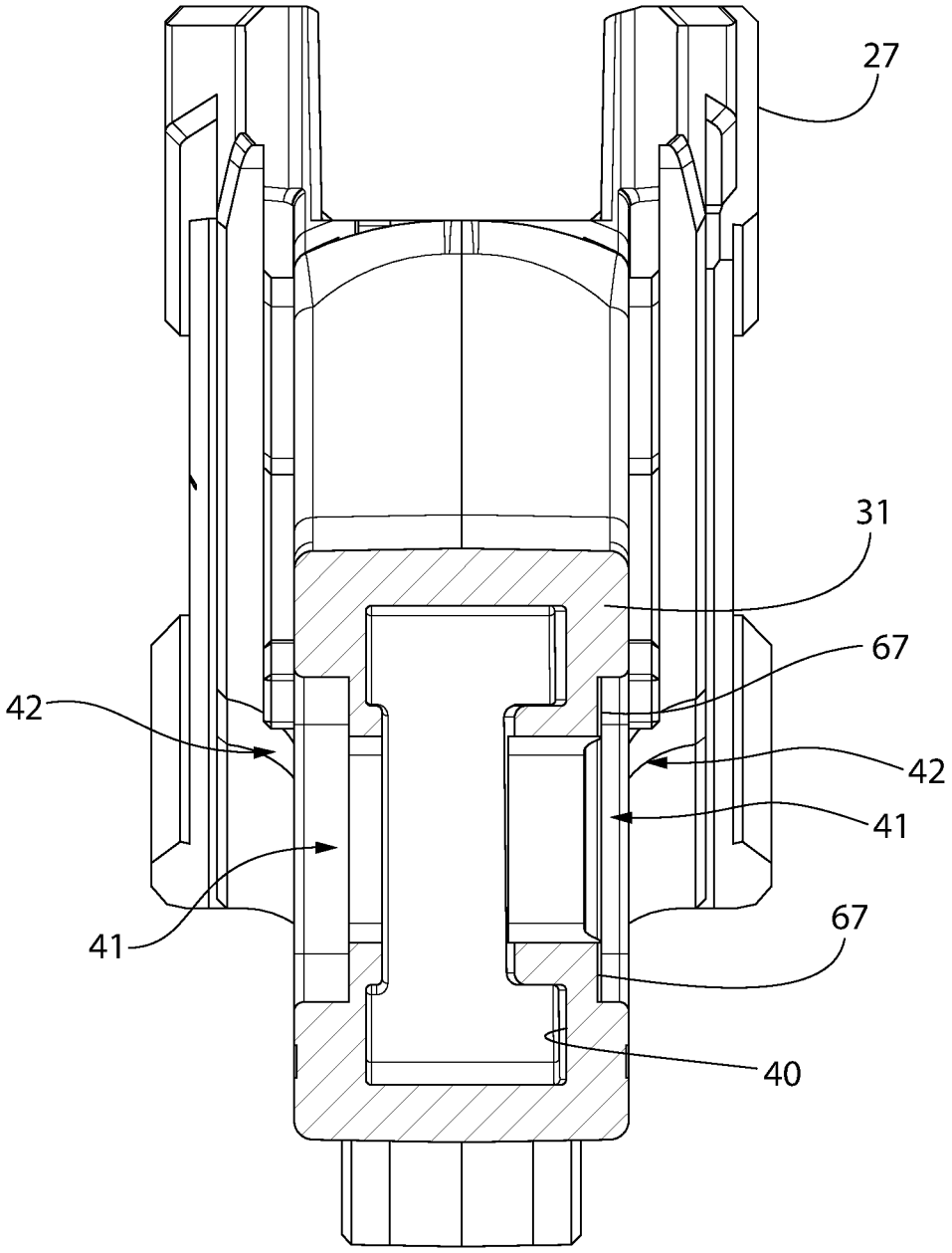
FIG. 36 is transverse cross section thereof showing an I-shaped longitudinal cavity of the rear mounting extension.

In one embodiment, the adjustment rail 50 may have an I-shaped transverse cross-sectional configuration (see, e.g. FIG. 33) tantamount to a structural I-beam for mechanical strength to resist rotational twisting or axial bending of the rail and butt pad assembly 33 attached thereto. The I-shaped cross section may be asymmetrical in one embodiment (see, e.g. FIG. 33) with the teeth 66 on the laterally shorter side of the mounting extension adjustment rail 50 (right side in FIG. 33). As shown in FIG. 27, the teeth 66 on the adjustment rail 50 are laterally offset so that the same toothed clamping blocks 60 can be used on both sides. When clamped, the clamping block teeth 65 on the right side have clearance so clamping block teeth 64 only clamp on teeth 67 of the extension rail 31, and the clamping block teeth 64 on the left side have clearance so clamping block teeth 65 only clamp on the mounting extension adjustment rail teeth 66. This arrangement allows the clamping blocks 60 and cheek rest 32 mounted thereto to move independently of the butt pad assembly 33 along the longitudinal axis LA in axial position, while still providing a robust clamping method for the assembly.

The butt pad assembly 33 is supported by the rail 50 in a cantilevered manner from the chassis rear mounting extension 31 as illustrated. Other structurally robust cross-sectional shaped may be used in other embodiments, such as T-shaped cross sections or simply rectangular/square cross-sectional shapes. Preferably, the adjustment rail 50 has a polygonal shape in lieu of a circular shape to prevent rotation relative to the rear mounting extension 31 since the present butt pad support system utilizes a single cantilevered point of support and mounting axis MA defined by adjustment rail 50, as further described herein.

The upper adjustment rail 50 is slideably supported and axially received in the rearwardly open longitudinal cavity 40 of the mid-stock mounting extension 31. The rail 50 is slideable between a plurality of axial positions relative to the rear mounting extension 31 to adjust the length of pull of the butt pad assembly 33. The axial positions may be indexed positions in one embodiment formed by a meshed arrangement of interlocking teeth, as further described herein. Longitudinal cavity 40 preferably may be complementary configured to the polygonal transverse cross section to the adjustment rail 50 of the butt pad assembly. This creates mutual but sliding engagement therebetween which prevents the adjustment rail 50 with butt pad assembly 33 from angularly twisting relative to the mounting extension 31. In one embodiment, the cross sections of the cavity 40 and adjustment rail 50 have an asymmetrical I-shaped configuration (see FIGS. 33-36).

A locking mechanism mounted on chassis rear mounting extension 31 is provided which allows the user to secure and lock the adjustment rail 50 to the rear mounting extension in a plurality of selected axial positions relative to the extension. Accordingly, the butt pad assembly 33 is slideable between and lockable in a plurality of preferably indexed axial positions on the rear mounting extension for adjusting a length of pull of the firearm. In one embodiment, the cheek rest 32 is also longitudinally adjustable being slideable between and lockable in a plurality of preferably indexed axial positions on the rear mounting extension 31 by the same locking mechanism. The cheek rest 32 is further vertically adjustable being slideable between and lockable in a plurality of preferably indexed vertical positions on the mounting extension 31 to adjust the height of the cheek rest. The same locking mechanism is configured and operable to lock the cheek rest 32 in a selected vertical position relative to the mounting extension 31.

Advantageously, the foregoing sole or single locking mechanism is configured to accomplish all of the above locked positions of the butt pad assembly 33 and cheek rest 32 simultaneously when the locking mechanism is in a locked position. This allows creation of an overall compact and lightweight buttstock assembly 30 operated by one locking mechanism. This contrasts to prior designs which generally rely on a separate locking mechanism for the length of pull adjustment and one for the cheek rest vertical adjustment. Furthermore, such prior designs generally do not provide axial adjustment of the cheek rest.

In one embodiment, the locking mechanism may comprise without limitation a spring-biased cam lever assembly 100 having a cam lever 101 movable between an open position in which the butt pad assembly 33 and cheek rest 32 are locked in position on the rear mounting extension 31 of the chassis (defined by mid-stock 27), and a closed position in which the butt pad assembly and cheek rest are slideable relative to the rear mounting extension. The cam lever assembly 100 further comprises a pair of uniquely configured clamping blocks 60 configured to selectively and lockingly engage the rear mounting extension 31 and adjustment rail 50 of the butt pad assembly 33. In one embodiment, the cam lever assembly 100 may comprise a double-acting cam lever. These components and their interaction are further described below.

Figure 43:
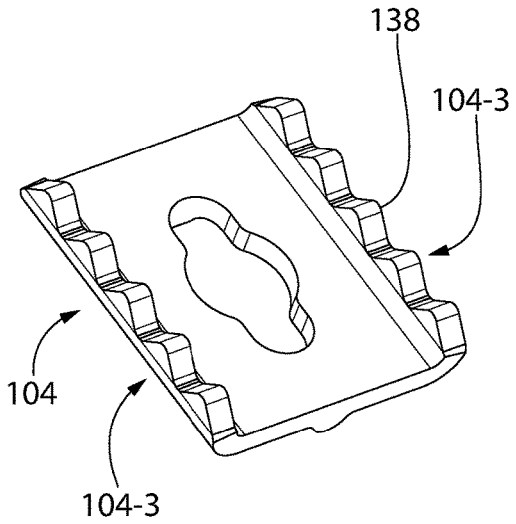
FIG. 43 is a first perspective view of a toothed locking washer of the locking mechanism.
Figure 44:
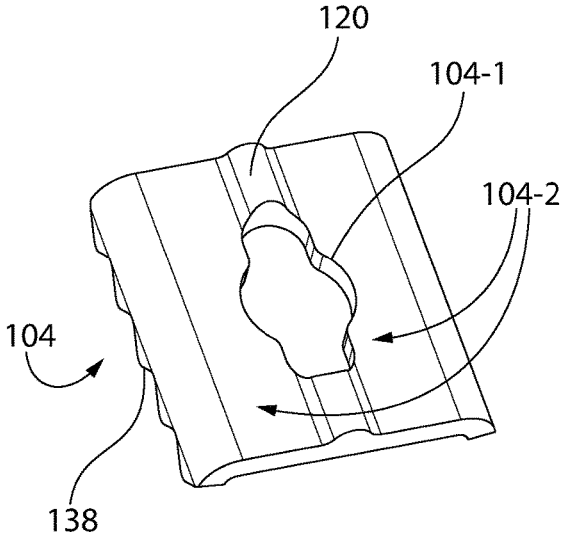
FIG. 44 is a second perspective view thereof.

Referring initially to FIGS. 16-29, cam lever assembly 100 generally comprises an elongated cam lever 101, transversely extending coupling shaft 103, a pair of locking washers 104, a finger nut 106, an opening spring 107, and a pair of clamping blocks 60. With additional reference to FIGS. 43-44, the washers 104 provide vertically oriented lateral bearing surfaces 104-2 on each side of the mounting extension 31 for the cam head 109 of cam lever 101 and finger nut 106 respectively to bear against when the cam lever assembly 100 is assembled to clamping blocks on the mounting extension. Washers 104 each include a central through opening 104-1 for insertion of coupling shaft 103 therethrough and include substantially flat bearing surfaces 104-2 on the outward facing side. Opening 104-1 may be a vertically elongated slot. In one embodiment, washers 104 may be generally rectilinear (e.g. rectangular or square) shaped as shown (see, e.g. FIGS. 43-44 showing the washers in isolation). The washers 104 are preferably made of metal, but non-metallic durable washers made of other materials such as polymers may be used.

The coupling shaft 103 extends laterally between and through the pair of clamping blocks 60 slideably disposed on mounting extension 31 of mid-stock 27 to operably couple the blocks together. One clamping block 60 each is disposed on each lateral side 42 of the mounting extension 31 and positioned to operably engage the chassis mounting extension 31 and butt pad assembly adjustment rail 50, as further described herein. In one embodiment, the coupling shaft 103 may be in the general form of an eye bolt having a threaded portion 103*a* on one end and a circular opening 103*b* ("eye") at the other enlarged end. Other configurations of coupling shafts may be used.

Cam lever 101 is shown and described as mounted on the right side of the cam lever assembly 100 and the right clamping block 60 in the present example; however, in other embodiments the cam lever may be mounted instead on the left clamping block 60 and will function in the same manner. This mounting may be preferable for left-handed firearm users or for right folding stocks. The cam lever 101 is therefore ambidextrous and may be positioned on either the right or left lateral side of the stock 26 to suit the user's preferences.

Cam lever 101 includes an elongated operating handle 108 and a cam head 109 at one end of the handle. Cam head 109 may have an oblong shape and comprises two diametrically opposing arcuate locking surfaces 110*a*, 110*b* and a flat release surface 111 disposed therebetween. The locking surfaces are on the short sides of the cam head. The cam head 109 may be a bifurcated structure forming two spaced apart halves defining a slot 112 therebetween. Slot 112 receives the enlarged end 103*c* of coupling shaft 103 with opening 103*b*. The opening 103*b* is concentrically aligned with mating holes formed in each half of the cam head 109 which all receive pivot pin 102 therethrough that pivotably couples the coupling shaft and cam lever 101 together. Pin 102 defines a pivot axis of the cam lever 101. To provide a smooth but tight fit between the coupling shaft 103 and cam head 109, the enlarged end of the coupling shaft may be flattened on each side to mate with corresponding flat interior surfaces of the cam head on each side of the slot 112. This fit allows rotation of the cam lever 101 without excessive play or wobbling which is undesirable.

The coupling shaft 103 extends transversely between the right and left sides of the mounting extension 31 of the mid-stock 27 and through the pair of clamping blocks 60. Starting from the right side of the firearm, coupling shaft 103 goes from the cam head 109 through the right washer 104, then through a laterally open central hole in the right clamping block 60, then through the longitudinal cavity 40 of mounting extension 31 via the laterally open pair of lateral windows 41, through the laterally open central hole of the left clamping block 60, through the left washer 104 so that the threaded end 103*a* of the coupling shaft protrudes outwards beyond the left washer and is exposed. The threaded end 103*a* of coupling shaft 103 rotatably receives finger nut 106 to adjust the tension in the cam lever assembly 100. The opening spring 107 is disposed around and between the clamping blocks 60 to bias the blocks apart away from the mid-stock mounting extension 31.

Spring 107 may be a helical compression spring in one embodiment; however, other type springs may be used. The spring 107 is positioned around the coupling shaft 103 between clamping blocks 60. The shaft 103 extends transversely/laterally through the longitudinal cavity 40 and windows 41 of the mid-stock mounting extension 31. One end of the spring abuts left clamping block 60 and the other end abuts the right clamping block (see, e.g. FIG. 27).

Figure 37:
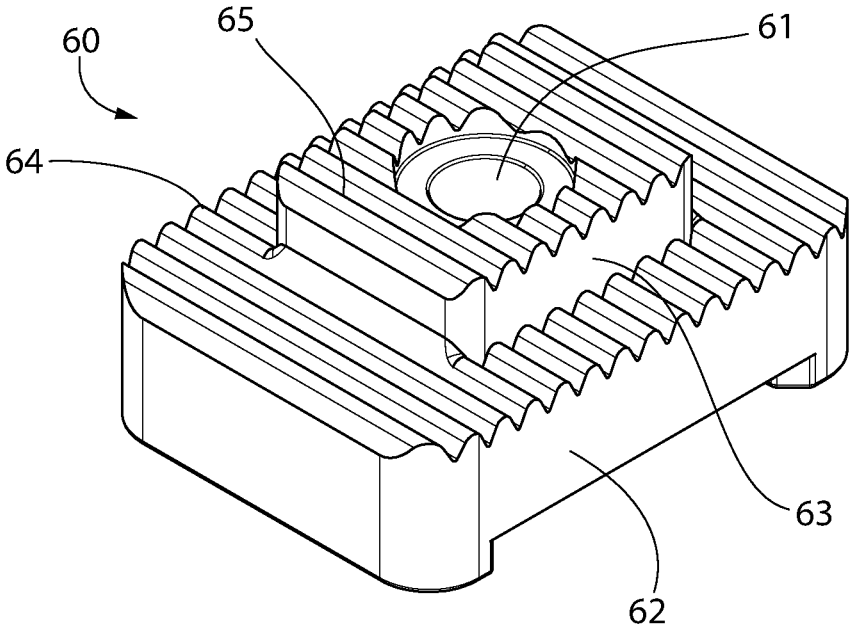
FIG. 37 is a first perspective view of a clamping block of the locking mechanism.
Figure 38:
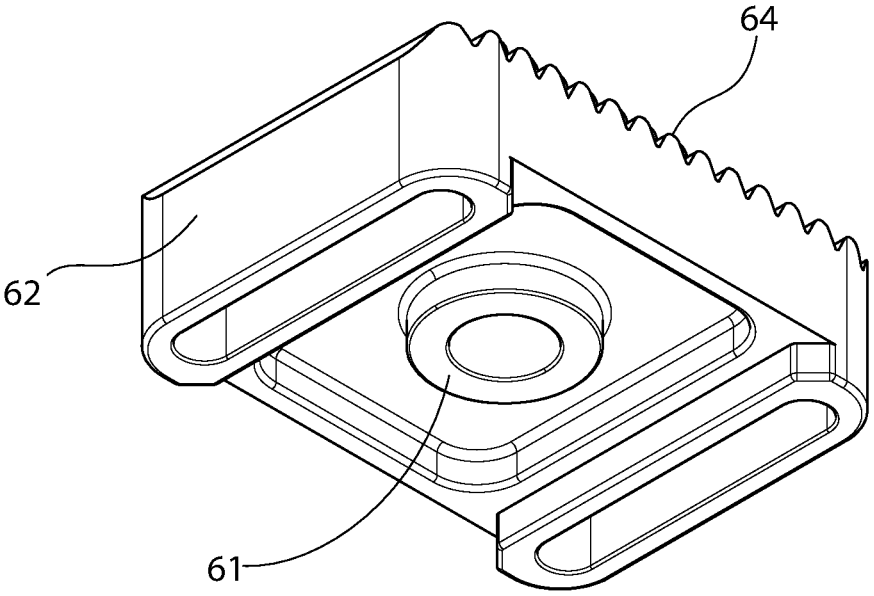
FIG. 38 is a second perspective view thereof.

FIGS. 37-38 shows the uniquely configured clamping block 60 in isolation, which provides dual duty to both clamp and lock the butt pad assembly 33 in axial position and lock the clamping block itself in axial position on the chassis (mid-stock) rear mounting extension 31. Clamping block 60 may have a rectilinear square or preferably rectangular body in one embodiment including a central opening or hole 61 for passage of the cam lever assembly coupling shaft 103 therethrough. The block body comprises a base portion 62 having a first set of serrated teeth 64 arranged for lockingly engaging rear mounting extension 31 of the mid-stock 27 (chassis), and a raised portion 63 having a second set of serrated teeth 65 arranged for lockingly engaging the forwardly extending adjustment rail 50 of the butt pad assembly 33. The base portion 62 has a greater surface area than the raised portion 63; the latter of which may be centered on the base portion as shown. The first and second sets of teeth 64, 65 lie in different flat planes or levels, and are therefore offset from each other. The sets of serrated teeth 64, 65 may comprise parallel rows of elongated teeth which assume a vertical orientation when the clamping blocks 60 are mounted on the chassis rear mounting extension 31. In one embodiment, as shown, each of the sets of teeth 64 and 65 may be oriented in the same direction and are parallel to each other.

The smaller raised portion 63 of each clamping block 60 is configured and dimensioned to project inwards through longitudinally-extending lateral windows 41 in the rear mounting extension 31 and into the longitudinal cavity 40. The teeth 65 on raised portion 63 lockingly engage a mating set of complementary configured serrated teeth 66 formed on the left lateral side 50-3 of the butt pad assembly adjustment rail 50 (see also FIGS. 30 and 32) when the cam lever assembly 100 is in the locked position. This fixes the butt pad assembly in a user-selected axial position. The meshed teeth 65, 66 provided indexed mounting positions. The teeth 66 on the adjustment rail 50 may be vertically oriented and extend axially along a majority of the length of the adjustment rail forming an axially elongated linear track of teeth. When the cam lever assembly 100 is in an unlocked position, the adjustment rail 50 is slideable through the longitudinal cavity 40 of the rear mounting extension 31 to allow adjustment of the firearm length of pull. The opposite lateral side 50-2 of the adjustment rail 50 may be plain without teeth in one embodiment (see, e.g. FIG. 31), thereby providing clearance between the C1 between the adjustment rail 50 and teeth 65 on raised portion 63 of the clamping block 60. This allows the butt pad assembly 33 to be adjusted in axial position independently of the axial position of the clamping blocks 60 and cheek rest 32 mounted thereto.

The larger base portion 62 of each clamping block 60 by contrast is intentionally dimensioned taller in height than the height of the mounting extension lateral windows 41 to remain outside thereof. Teeth 64 lockingly engage a mating set of complementary configured serrated teeth 67 formed on the right lateral side 42 of the mid-stock mounting extension 31 when the cam lever assembly 100 is in the locked position. This fixes the clamping blocks 60 in a user-selected axial position on the chassis, thereby in turn setting the longitudinal/axial position of the cheek rest 32 mounted to clamping blocks, as further described herein. The meshes teeth 64 and 67 provided indexed mounting positions. The teeth 67 on the mounting extension may be vertically oriented and extend axially along the length of the extension rail. In one embodiment, teeth 67 may be omitted on the left lateral side 42 of the extension 31. The teeth 67 on the right lateral side 42 of mounting extension 31 may be arranged in two parallel rows or tracks of teeth 66; one each above and below the lateral windows 41 (see, e.g. FIG. 17). The teeth 67 may further continue around the front and rear ends of the window 41 as shown. In one embodiment, the teeth 67 may be formed within longitudinal recesses 43 surrounding the windows 41 as shown. When the cam lever assembly is in an unlocked position, the clamping blocks 60 with cheek rest 32 mounted thereto are slideable along the chassis rear mounting extension 31 to allow adjustment of the cheek rest longitudinal position.

It bears noting that the foregoing mating sets of teeth provide discrete indexed adjustment positions of the butt pad assembly 33 and the clamping blocks 60/cheek rest 32 relative to the rear mounting extension 31 of the mid-stock chassis. In other possible acceptable embodiments, however, the teeth on the clamping blocks 60, adjustment rail 50, and mounting extension 31 may be omitted and the compressive clamping force produced by cam lever assembly 100 may relied upon alone to retain the selected axial positions via frictional engagement between the slideable parts.

The opening spring 107 biases the clamping blocks 60 laterally apart which defines the unlocked position of the cam lever assembly 100 in which the blocks do not lockingly engage the chassis mounting extension 31 or adjustment rail 50 of the butt pad assembly 33. This allows the clamping blocks 60 to slide axially forward and rearward relative to the mounting extension 31 for adjusting the axial position of the blocks relative to the extension. This also allows the adjustment rail 50 to slide axially forward and rearward for adjusting the axial position (length of pull) of the butt pad assembly 33.

The clamping blocks 60 are laterally movable together and apart via operation of the cam lever 101 between an inward or closed locked position and an outward or open unlocked position. In the locked position, the clamping blocks 60 are forced inwards and together by the lever mechanism to compressively and lockingly engage the mounting extension 31 and adjustment rail 50 for locking the clamping blocks in axial position. When locked in position, the clamping blocks 60 thus cannot slide forward/rearward. In the unlocked position, the clamping blocks 60 are forced apart by the opening spring 107 to at least partially disengage and allow adjustment in axial position of the cheek rest 32 and butt pad assembly 33.

Operation of the cam lever assembly 100 for adjusting the length of pull will now be briefly described with initial general reference to FIGS. 18-29 and the following process or method. The double-acting cam lever 101 is pivotably movable from an open center neutral or release position in which the cam lever assembly linkage is loosened (see, e.g. FIGS. 13, 20, 21, 24, 25, 28 and 29, to one of two closed diametrically opposed side locking positions in which the cam lever assembly linkage is tightened (see, e.g. FIGS. 12, 14, 18, 19, 22, 23, 26, and 27). The locking positions may be at least 180 degrees apart and the release position is between the locking positions, preferably midway between the locking positions in one embodiment.

Beginning with FIGS. 13, 20, 21, 24, 25, 28 and 29, the cam lever assembly 100 is shown open with the cam lever 101 in the loosened center release position. In the present non-limiting embodiment, the open center release position of the cam lever 101 is characterized by the operating handle 108 being oriented substantially horizontal and perpendicular to the right lateral side 42 of the mid-stock mounting extension 31 (the term "substantially" recognizing that the lever may be canted slightly to one or the other side of absolute center so long as the locking surfaces 110 of cam head 109 are not positively engaged with the right washer 104 to tension the coupling shaft 103 enough to lock the adjustment rail 50 in axial position). The cam lever assembly 100 is in the unlocked position when the cam lever 101 is in the center release position, in which the upper adjustment rail 50 of butt pad assembly 33 can slide axially between the clamping blocks 60 and through the mid-stock rear mounting extension 31 for adjusting the longitudinal position of the butt pad assembly, or length of pull. The flat release surface 111 of cam head 109 is lightly engaged with the washer 104 (bearing surface 104-2) when the lever 101 is in the center release position. Placing the cam lever in this center release position allows the clamping blocks 60 to open and spread fully apart (under the biasing action of spring 107), thereby moving the clamping blocks 60 apart to the open position for adjusting the length of butt pad assembly 33 (length of pull) and/or the longitudinal position of the clamping blocks 60/cheek rest 32. Spring 107 urges the laterally moveable clamping blocks 60 outwards by the maximum amount permitted and limited by prior adjustment and tightening of the finger nut 106.

Because the cam head flat release surface 111 on cam head 109 of the cam lever 101 is closer to the pivot axis of the cam lever 101 defined by pin 102 than either of the two arcuate locking surfaces 110*a*, 110*b* on the cam head, the distance between the release surface 111 and the bearing surface 104-2 on locking washer 104 acted upon by lever cam head 109 in this example is the shortest. Therefore, the cam lever 101 is in a slightly loosened condition allowing the biasing spring 107 to laterally displace the clamping blocks 60 outwards and apart slightly enough to disengage the meshed teeth 65, 66 and allow the butt pad assembly upper adjustment rail 50 to slide through the clamping blocks. With clamping pressure released on the adjustment rail 50, the use may slide the butt pad assembly 33 forward or rearward to the desired axial position to shorten or lengthen the buttstock (e.g. length of pull). This contrasts to the tightened or locked condition of the cam lever 101 when either of the two locking surfaces 110*a*, 110B engage the washer 104, thereby forcing the clamping blocks 60 laterally inwards to clamp the adjustment rail 50 in axial position.

Once the desired length of pull has been reached, the butt pad assembly 33 is ready to be locked into axial position. The user may pivot the cam lever 101 vertically about the horizontal pivot axis (defined by pin 102) to either one of the two up or down locking positions shown in FIGS. 12, 14, 18, 19, 22, 23, 26, and 27 provided by the double-acting cam lever mechanism. In the up or down locking positions, the operating handle 108 of cam lever 101 will either point up or down respectively being oriented either parallel or obliquely to the opposing lateral sides 42 of the chassis rear mounting extension 31 and sides of the cheek rest 32.

When the cam lever 101 is rotated to one of the up or down locking positions, the respective arcuate locking surface 110*a* or 110*b* engages the bearing surface 104-2 defined by right locking washer 104. This pulls the coupling shaft 104 transversely to the right side of the stock towards the cam lever 101 against the outward biasing force of spring 107 acting in a direction to push the clamping blocks 60 apart. The opening spring 107 is compressed as the clamping blocks 60 are drawn together into the closed position. The first set of teeth 65 on each clamping block 60 mesh with the teeth 66 on the butt pad assembly adjustment rail 50 to lock the rail in place. The butt pad assembly 33 is no longer axially movable with respect to the mounting extension 31 and secured in the axial position selected by the user. Simultaneously, the second set of teeth 64 mesh with the teeth 67 on the chassis mounting extension 31 to lock the clamping blocks 60 and cheek rest 32 mounted thereto in axial/longitudinal position on the mounting extension 31.

It bears noting that the same foregoing length of pull adjustment steps are also used to adjust the longitudinal position of the clamping blocks 60 and cheek rest in a similar manner. When the cam lever assembly 100 is unlocked the blocks 60 may be slid forward and rearward to the desired axial position. The cam lever assembly may then be locked in the manner previously described herein to fix the axial position of the clamping blocks (and cheek rest 32 mounted thereto).

According to another aspect of the invention, an indexed detent tensioning mechanism is provided by finger nut 106 for adjusting the tension in the cam lever assembly 100.

Figure 42:
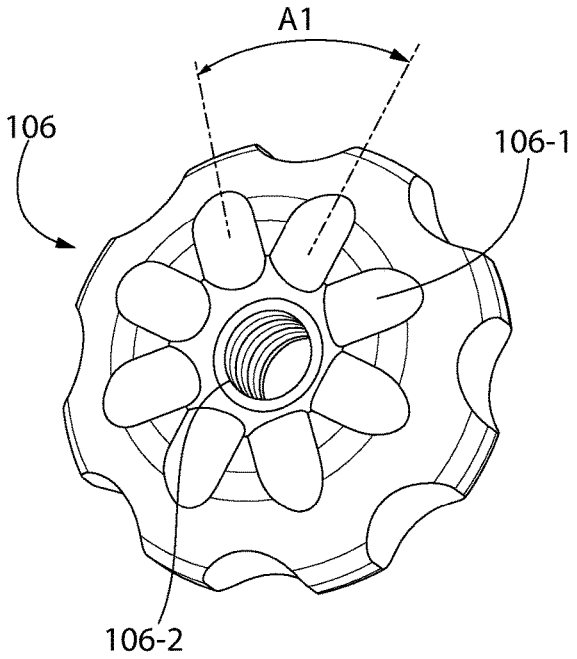
FIG. 42 is a perspective view of a detent finger nut for adjusting tension in the locking mechanism.

Referring to FIG. 42, finger nut 106 is round and includes a plurality of elongated radially extending recessed detents 106-1 formed on the inward facing side of the nut. Even or odd numbers of detents 106-1 may be provided. In one embodiment, the detents may be arranged in diametrically opposed pairs. Eight detents 106-1 may be provided as one example arrangement; however, more of less detents may be used as appropriate. The detents 106-1 may be elongated depressions which extend radially outwards from the threaded central hole 106-2 which is threaded onto the exposed threaded end 103*a* of coupling shaft 103 that defines a rotational axis for finger nut 106.

As the finger nut 106 is rotated, detents 106-1 alternatingly mate with and selectively engage a protruding linear index rib 120 disposed on left locking washer 104 (see, e.g. FIG. 43). Rib 120 may be vertically oriented and centered on the washer between the front and rear sides. Detents 106-1 are circumferentially spaced apart by a suitable angle A1 selected to provide a plurality of circumferential index positions for tightening the cam lever linkage (e.g. coupling shaft 103).

In operation, when the cam lever 101 is in one of the two tightened locking positions, the finger nut 106 is held securely in place from loosening by the engagement between the washer index rib 120 and an engaged diametrically opposed pair of detents 106-1 (one each on opposite sides of through hole 106-2) which prevents rotation or loosening of the nut due to vibration when the firearm is fired. The coupling shaft 103 and cam lever 101 assisted by spring 107 apply an inward directed pulling force on the finger nut 106, thereby maintaining positive engagement of the rib 120 in the detents 106-1. When the cam lever 101 is instead released and pivoted to the opened center release position to loosen the linkage, the opening spring 107 still provide sufficient pressure which holds the washer 105 and finger nut 106 against each other, but clearance is now created sufficient to allow the washer and nut to separate slightly when the nut is turned by the user.

The foregoing indexed detent action is useful for setting the tension in the cam lever assembly 100. If the user closes the cam lever 101 and finds it too loose to operate the clamping blocks 60 properly, the cam lever can be positioned in the center release position and the finger nut can be rotated and tightened in ⅛ turn increments (in the present example with eight detents), with a positive detent felt at each increment by the user. The detent action also advantageously creates an "clicking" noise providing not only a tactile sensation, but an audible signal as well each time a circumferential index position is reached. The cam lever 101 can then be easily reclosed, testing the new setting, and the process can be repeated until the desired tension is achieved. This quick and intuitive adjustment method allows a positive and consistent locking force to be maintained in both closed cam lever locking positions as well as over the wide range of adjustment where part tolerance may allow some variation.

The cheek rest 32 adjustment and locking features will now be described.

Figure 39:
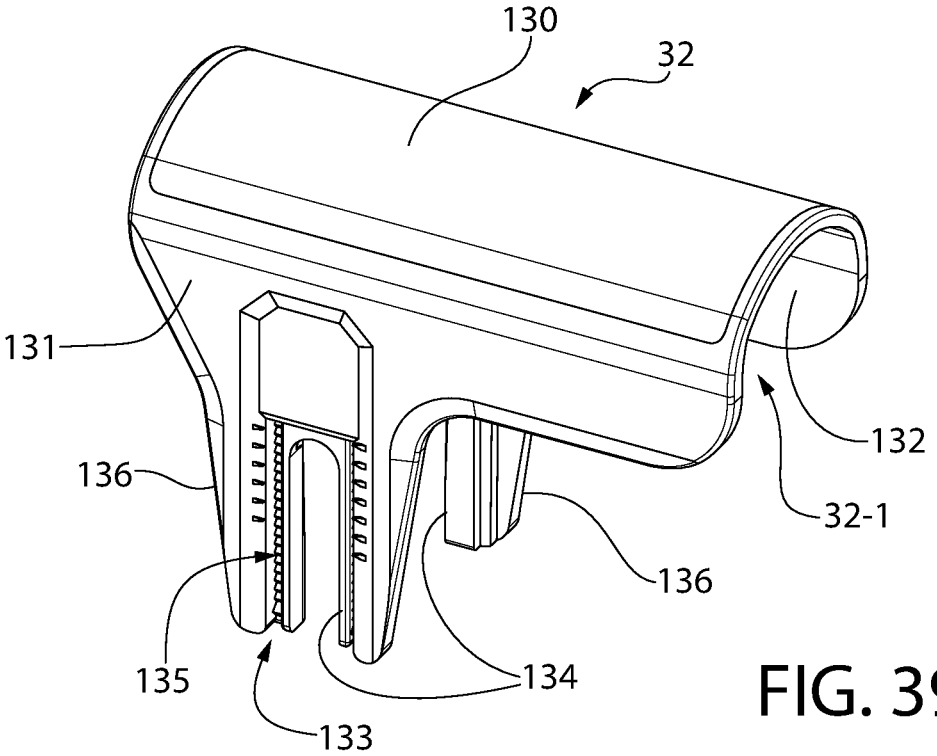
FIG. 39 is a right perspective view of the cheek rest.
Figure 40:
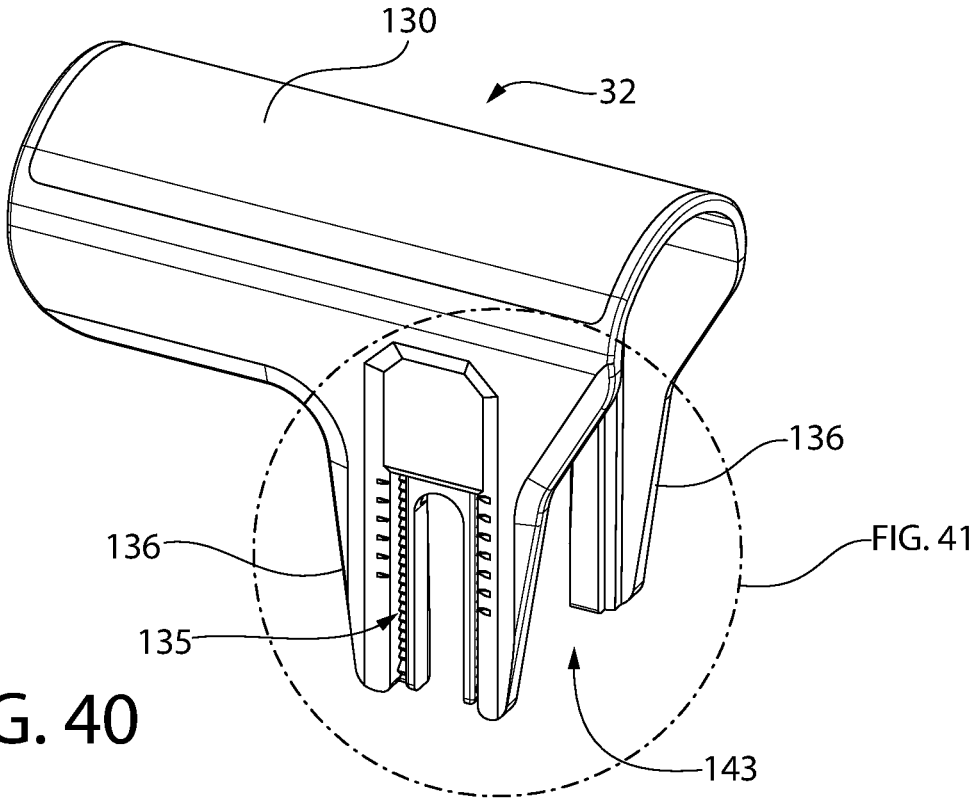
FIG. 40 is a left perspective view thereof.
Figure 41:
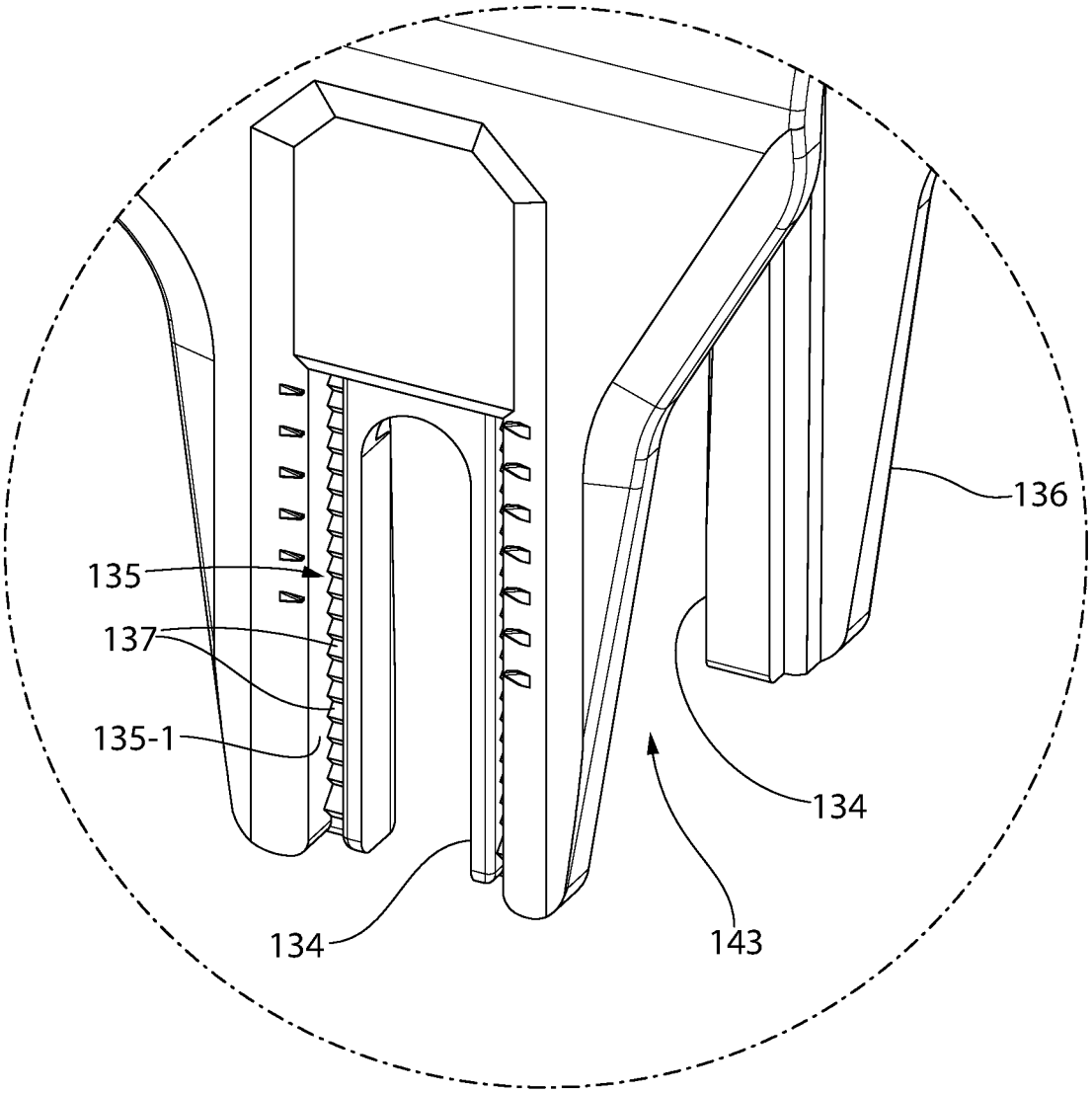
FIG. 41 is an enlarged detail taken from FIG. 40.

Referring initially to FIGS. 39-41, the cheek rest locking mechanism in one embodiment may advantageously utilize the same double-acting cam lever assembly 100 as previously described for the butt pad assembly locking mechanism. Cam lever assembly 100 is thus a triple-acting locking mechanism advantageously operable to lock the butt pad assembly and cheek rest in position via operation of a single cam lever 101 for convenience and compactness. The axial/longitudinal position of cheek rest 32 on the firearm (i.e. rear mounting extension 31 of mid-stock or chassis) is adjustable and lockable in place via operation of the clamping blocks 66 and cam lever assembly 100 in the manner previously described herein with respect to length of pull adjustment. This is because the cheek rest 32 is mounted directly to the clamping blocks 60, which in turn are slideable in axial/longitudinal position on the chassis rear mounting extension 31. Height adjustment of the cheek rest 32 is also accomplished using the same cam lever 101, which is configured to cooperate with height adjustment/indexing features of the cheek rest.

Cheek rest 32 has a generally U-shaped body including an upper main portion forming an arcuately curved top 130 and contiguous opposing right and left sidewalls 131 and 132. The main portion is axially elongated in the direction of the longitudinal axis LA and defines a longitudinal passage 32-1. When cheek rest 32 is in it lowermost adjustment position, the chassis extension rail 31 may partially enter the passage 32-1 in some configurations. A pair of bifurcated lateral adjustment legs 136 extends downwardly from the sidewalls 131, 132 forming therein a vertical slot 134 have a closed top end and open bottom end. A toothed rack 135 is disposed on each side of the slots 134 forming a pair of horizontally spaced apart toothed racks on each adjustment leg. Each toothed rack 135 comprises a plurality of teeth 137 in a linear or serial arrangement. The toothed racks 135 in each pair are arranged parallel to each other and transversely/perpendicularly to longitudinal axis LA (when the cheek rest 32 is mounted on the chassis rear mounting extension 31). In one embodiment, each toothed rack 135 may be recessed within a linear channel 135-1 (best shown in FIGS. 17 and 40).

In one embodiment, the vertical toothed racks 135 are arranged to engage mating parallel and horizontally spaced apart linear rows or arrays of teeth 138 formed on locking washers 104 which act as locking elements. The washer teeth 138 project inwardly toward the toothed racks 135 on the right and left lateral adjustment legs 136 of the cheek rest 32 which are disposed between the washers 104 and the clamping blocks 60 (see, e.g. FIGS. 27 and 29). The toothed racks 135 formed on the cheek rest 32 are movable upwards and downwards along the vertical rows of teeth 138 on the washers (which remain fixed in vertical position) into a plurality of indexed positions formed by the meshed teeth. Washers 104 on each lateral side 42 of the butt pad assembly mounting extension 31 in one embodiment may have a generally U-shaped cross-sectional shape with two inwardly turned side flanges 104-3 on which the spaced apart vertical rows of teeth 138 are formed to lockably engage the cheek rest. The teeth 137 and 138 are mutually configured with an appropriate profile/contour that allows them to slideably move along each other as the cheek rest is adjusted when the cam lever 101 is in the release position.

In other embodiments contemplated, it bears noting than only one of the washers 104 may have teeth 138 and the other washer may be toothless. Accordingly, only one of the adjustment legs 136 of the cheek rest 32 will provide the desired indexing type adjustment of the cheek rest 32 and maintenance of the adjusted position which is an operable arrangement. However, use of two toothed washers 104 provides increased holding power for locking the cheek rest 32 in vertical position particularly in case the firearm is dropped and impacts a structure during carry or use.

Figure 45:
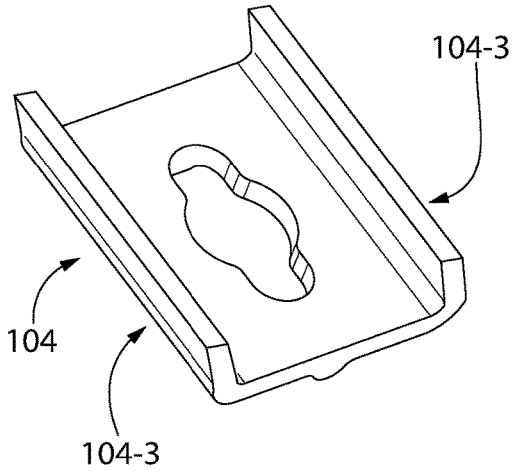
FIG. 45 is a perspective view of an alternative toothless locking washer of the locking mechanism.
Figure 46:
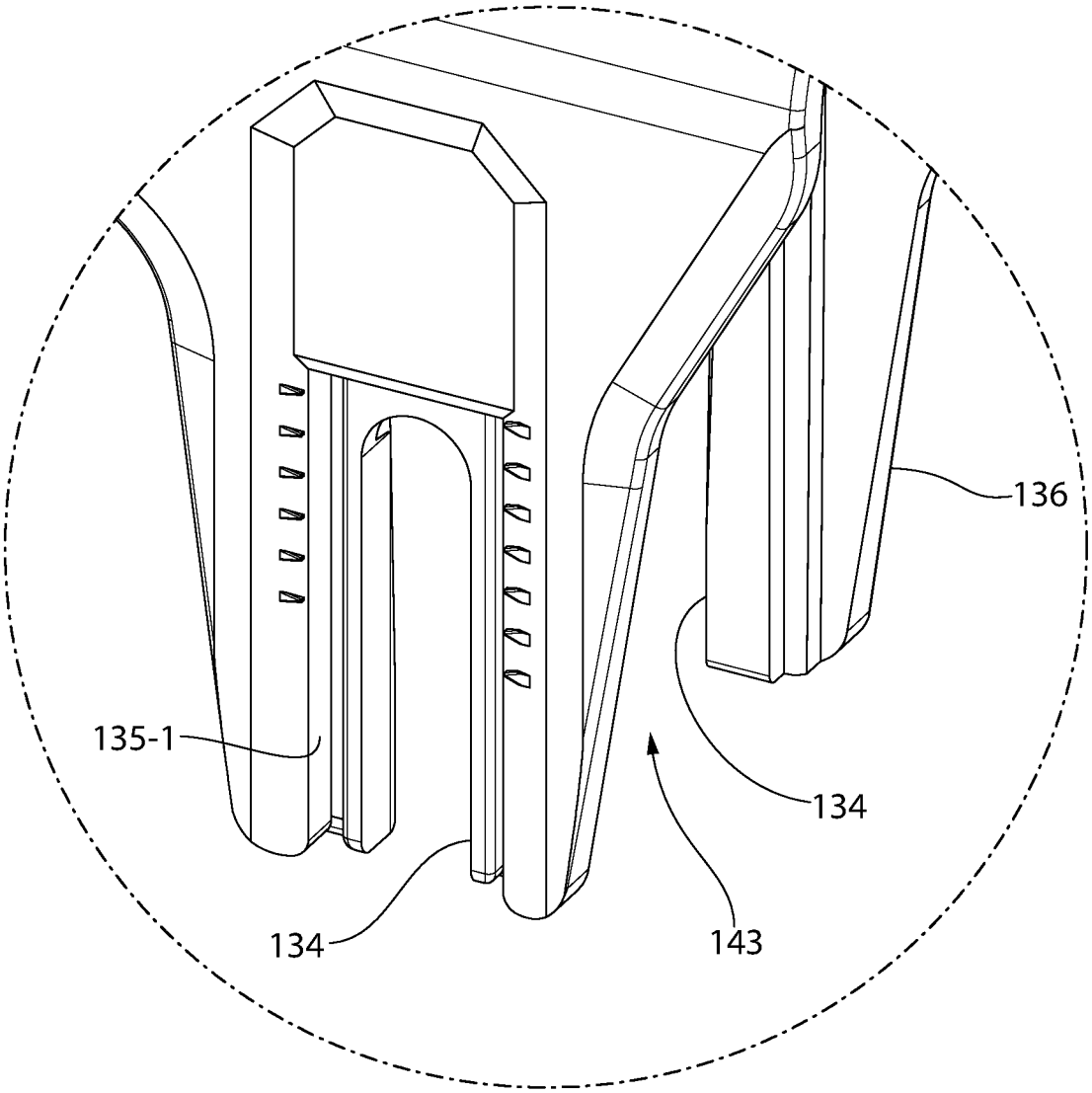
FIG. 46 is an enlarged detail of an alternative toothless cheek rest usable with the toothless washer of FIG. 45.

In yet other possible embodiments, it bears noting that the toothed racks 135 on cheek rest 32 and teeth 138 on locking washers 104 on one or both may be omitted to rely on the clamping force produced by cam lever assembly 100 alone to retain the selected vertical position of the cheek rest via mutual frictional engagement between the slideable parts. FIGS. 45 and 46 show this alternative embodiment. FIG. 45 depicts a toothless locking washer 104A and a toothless cheek rest 32A is shown in FIG. 46. The toothless locking washer includes the two inwardly turned side flanges 104-3 previously described herein which act as locking elements that are slideably received in channels 135-1 of cheek rest 32A to lock the cheek rest in vertical position when the cam lever assembly 100 is locked. Vertical adjustment of the cheek rest on chassis rear mounting extension 31 is the same as described elsewhere herein for the toothed embodiments.

Referring back now to the embodiment of FIGS. 39-41, cheek rest 32 is adjustable into a plurality of indexed vertical positions with respect to the rear mounting extension 31 of the chassis and firearm 20. Cam lever 101 has a center release position and two opposing locking positions (e.g. up or down) as previously noted because the lever is oriented vertically. Lever 101 is pivotally movable upward or downwards between the two locking positions for cheek rest 32 height adjustment as well as to adjust the longitudinal position of the cheek rest and length of pull of the butt pad assembly 33.

Figure 25:
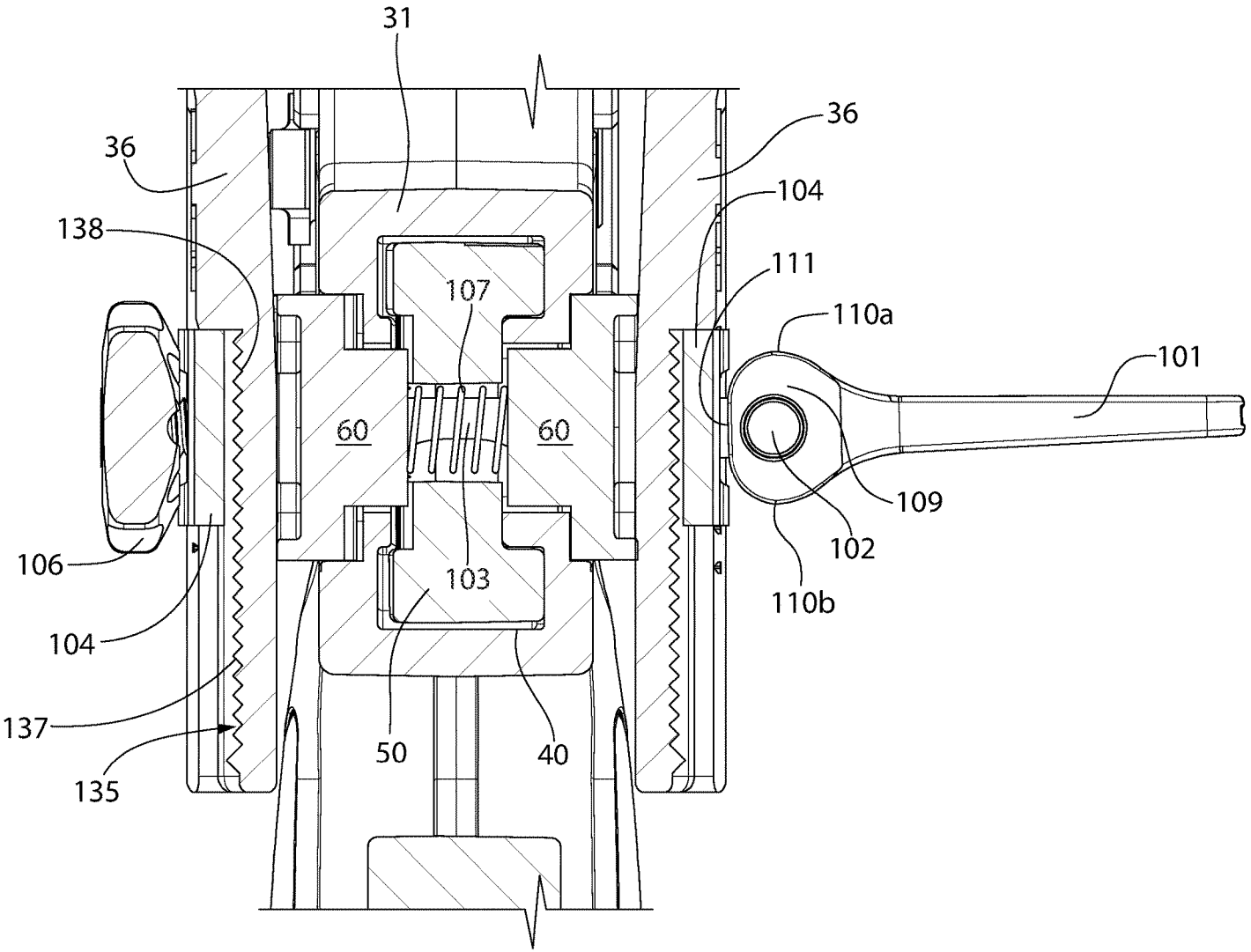
FIG. 25 is an enlarged detail from FIG. 23.
Figure 26:
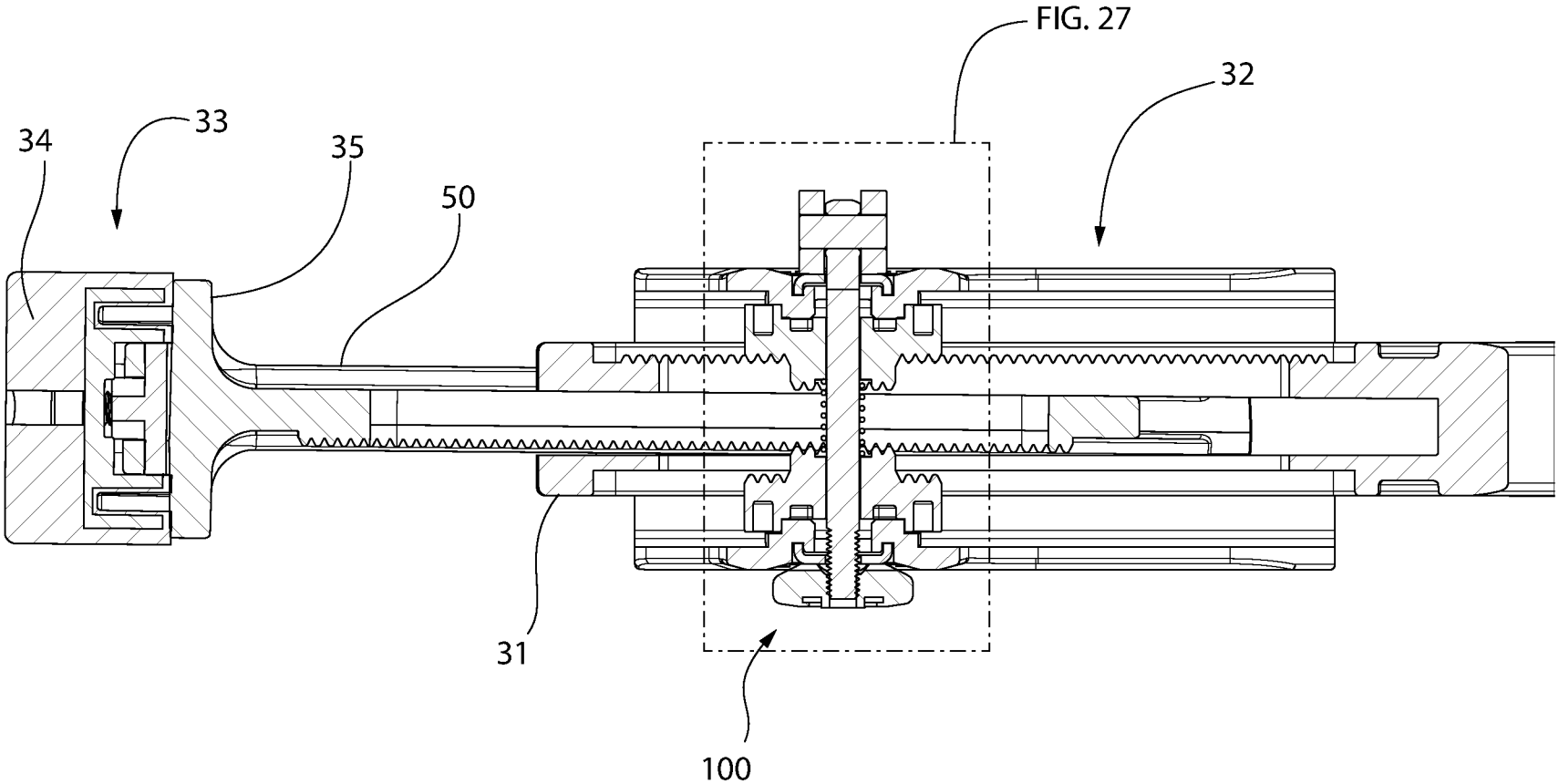
FIG. 26 is a top longitudinal cross-sectional view of the buttstock assembly showing the locking mechanism in a locked position with cam lever in a locking position.
Figure 29:
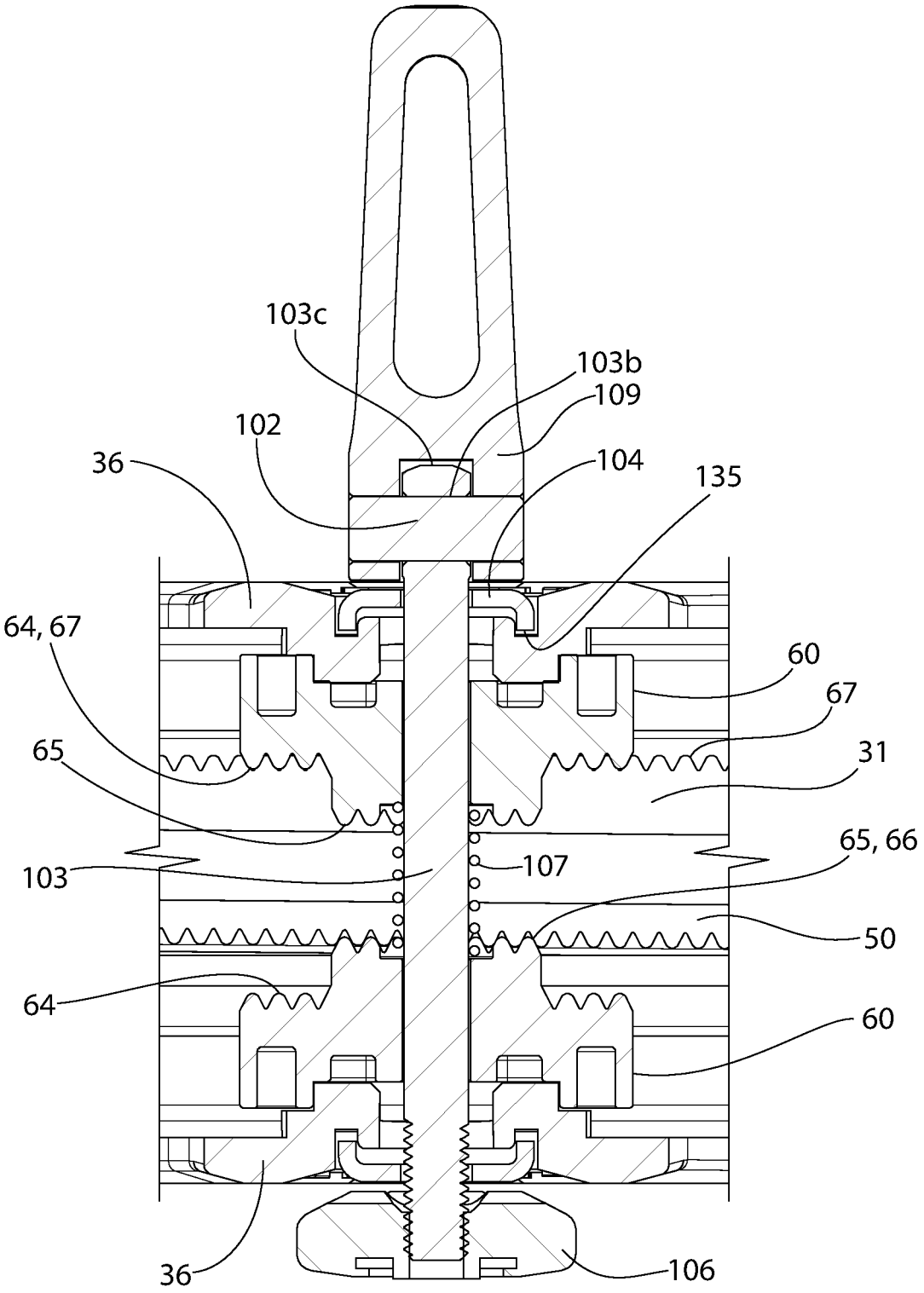
FIG. 29 is an enlarged detail from FIG. 28.
Figure 30:
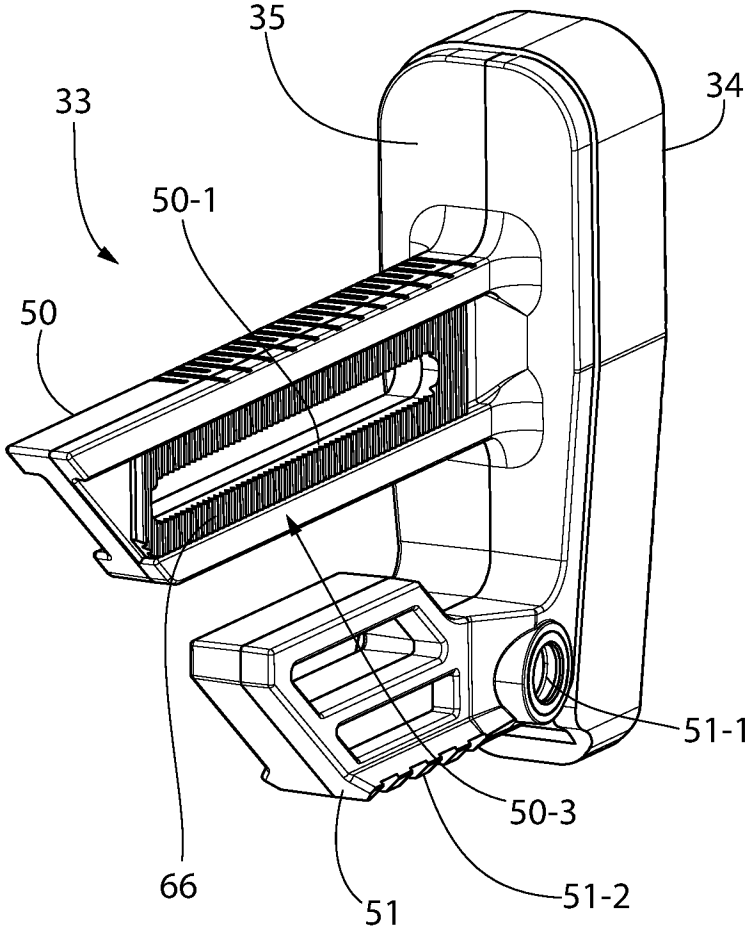
FIG. 30 is a left front perspective view of the butt pad assembly of the buttstock.

In operation, when the cam lever 101 is in the opened center release position (see, e.g. FIG. 25 or 29, the cheek rest 32 may be slid up or down in vertical position relative to the rear mounting extension 31 of the mid-stock 27 (chassis). The toothed racks 135 on each of the cheek rest right and left adjustment legs 136 engage and slip over the rows of teeth 138 on washers 104 (which remain stationary in vertical position with the cam lever 101 and related components). The biasing force imparted by the spring 107 of the cam lever assembly 100 against clamping blocks 60 force them laterally outwards to create a ratcheting action with accompanying audible "click" and a tactile sensation each time the cheek rest is incrementally raised or lowered in an indexed manner along the lightly meshing teeth. It bears noting that the same audible ratcheting action occurs when the cheek rest 32 (mounted to the clamping blocks 60) is slid forward and rearward on the mounting extension 31, or when the adjustment rail 50 of the butt pad assembly 33 is slid forward or rearward.

When the desired cheek rest position is reached, the cam lever 101 is folded up or down against the cheek rest 32 into either of the two closed locking positions. This tightly meshes the cheek rest and locking washer mating teeth 137, 138 to lock the cheek rest in vertical position.

A method or process for adjusting the butt pad assembly and cheek rest of a firearm will now be briefly summarized. The triple-acting locking mechanism provides lockable longitudinal (horizontal) adjustability for both the butt pad assembly 33 and cheek rest 32, and lockable vertical adjustability for the cheek rest.

In one embodiment, the method may comprise: providing a firearm stock including a longitudinally-extending chassis defining a mounting axis, a butt pad assembly slideably movable on the chassis in axial position, a vertically-adjustable cheek rest slideably movable on the chassis in axial position, and a triple-acting locking mechanism operably coupled to the butt pad assembly and cheek rest, wherein the locking mechanism is in a locked position locking the axial position of the butt pad assembly and cheek rest, and locking the cheek rest in a vertical position; changing the locking mechanism to an unlocked position which unlocks the butt pad assembly and cheek rest; sliding the butt pad assembly and cheek rest forward or rearward to desired axial positions of each; and changing the locking mechanism back to the locked position locking the butt pad assembly and cheek rest in the desired axial positions. The method may further comprise adjusting the vertical position of cheek rest when the locking mechanism is in the unlocked position, and changing the locking mechanism to the locked position to lock the vertical position of the cheek rest. In one embodiment, the locking mechanism may be a cam lever assembly having a cam lever movable between a release position and at least one locking position. In the same or other embodiments, the locking mechanism comprises a pair of clamping blocks laterally movable together and apart, the clamping blocks (1) lockingly engaging the chassis and butt pad assembly when the locking mechanism is in the locked position which locks the butt pad assembly and cheek rest in axial position, and (2) disengaging the chassis and butt pad assembly when the locking mechanism is in the unlocked position to allow adjustment of butt pad assembly and cheek rest in axial position. The cheek rest may be mounted to the clamping blocks which are slideable along the chassis to change the axial position of the cheek rest.

Numerous variations of the foregoing method and order of steps are possible depending on the needs and preferences of the user for adjusting the buttstock.

While the foregoing description and drawings represent exemplary embodiments of the present disclosure, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes described herein may be made within the scope of the present disclosure. One skilled in the art will further appreciate that the embodiments may be used with many modifications of structure, arrangement, proportions, sizes, materials, and components and otherwise, used in the practice of the disclosure, which are particularly adapted to specific environments and operative requirements without departing from the principles described herein. The presently disclosed embodiments are therefore to be considered in all respects as illustrative and not restrictive. The appended claims should be construed broadly, to include other variants and embodiments of the disclosure, which may be made by those skilled in the art without departing from the scope and range of equivalents.

What is claimed is:

1. An adjustable stock assembly for a firearm, the stock comprising:

a longitudinal axis;

a chassis comprising a main body configured for mounting a receiver and an axially elongated rear mounting extension extending rearwardly from the main body;

a butt pad assembly slideably coupled to the rear mounting extension, the butt pad assembly slideable between a plurality of axial positions on the rear mounting extension for adjusting a length of pull of the firearm;

a cheek rest slideably coupled to the rear mounting extension, the cheek rest slideable between a plurality of vertical positions on the rear extension; and a locking mechanism coupled to the rear mounting extension and changeable between a locked and unlocked position, the locking mechanism configured to simultaneously lock both the butt pad assembly in one of the axial positions and the cheek rest in one of the vertical positions respectively;

wherein the butt pad assembly includes an axially extending forward adjustment rail slideably inserted into a longitudinal cavity of the rear mounting extension of the chassis;

wherein the locking mechanism comprises a pair of clamping blocks biased apart by a spring, the clamping blocks movable together to clampingly engage the adjustment rail of the butt pad assembly to lock the butt pad assembly in axial position when the locking mechanism is in the locked position.

2. The adjustable stock according to claim 1, wherein the cheek rest is slideably mounted directly to the pair clamping blocks and vertically adjustable on the clamping blocks.

3. The adjustable stock according to claim 2, wherein the clamping blocks are longitudinally slideable forward and rearward on the mounting extension for adjusting an axial position of the cheek rest, the cheek rest lockable in axial position when the locking mechanism is in the locked position.

4. The adjustable stock according to claim 1, wherein the clamping blocks each have a first portion engageable with one of a pair of lateral sides of mounting extension of the chassis, and a second raised portion insertable through lateral windows for engaging the adjustment rail of the butt pad assembly.

5. The adjustable stock according to claim 4, wherein the first portion has a first set of serrated teeth which engage mating serrated teeth on the mounting extension of the chassis, and a second raised portion having a second set of serrated teeth which engage mating serrated teeth on the adjustment rail of the butt pad assembly.

6. The adjustable stock according to claim 5, wherein the serrated teeth of the mounting extension are arranged in parallel horizontal rows of vertical teeth disposed above and below the lateral windows in the mounting extension.

7. The adjustable stock according to claim 2, wherein the cheek rest has a U-shaped body comprising spaced apart adjustment legs extending downwardly on opposing lateral sides from an arcuately curved top portion, the adjustment legs each mounted to a respective clamping block by an outboard locking washer of the locking mechanism.

8. The adjustable stock according to claim 7, wherein the locking washers are operable to compress the adjustment legs against the clamping blocks to fix the vertical position of the cheek rest when the locking mechanism is in the locked position.

9. The adjustable stock according to claim 8, wherein the locking washers include a pair of inward turned side flanges which define locking elements that engage the adjustment legs of cheek rest to lock the cheek rest in vertical position.

10. The adjustable stock according to claim 8, wherein the locking washers include inward facing teeth which engage a mating outward facing toothed rack formed on the adjustment legs of cheek rest to lock the cheek rest in vertical position.

11. An adjustable stock assembly for a firearm, the stock comprising:

a longitudinal axis;

a chassis comprising a main body configured for mounting a receiver and an axially elongated rear mounting extension extending rearwardly from the main body;

a butt pad assembly slideably coupled to the rear mounting extension, the butt pad assembly slideable between a plurality of axial positions on the rear mounting extension for adjusting a length of pull of the firearm;

a cheek rest slideably coupled to the rear mounting extension, the cheek rest slideable between a plurality of vertical positions on the rear extension; and a locking mechanism coupled to the rear mounting extension and changeable between a locked and unlocked position, the locking mechanism configured to simultaneously lock both the butt pad assembly in one of the axial positions and the cheek rest in one of the vertical positions respectively;

wherein the adjustment rail has an asymmetrical I-shaped cross sectional configuration and the longitudinal cavity of the rear mounting extension of the chassis has a complementary configured cross-sectional configuration.

12. The adjustable stock according to claim 1, wherein the locking mechanism comprises a cam lever assembly having a cam lever pivotably movable between a locked position in which the butt pad assembly and cheek rest are each locked in position on the rear mounting extension of the chassis, and a release position in which the butt pad assembly and cheek rest are each slideably adjustable relative to the rear mounting extension.

13. The adjustable stock according to claim 12, wherein the cam lever assembly is a double-acting second cam lever assembly, the cam lever including an elongated operating handle and a cam head comprising two opposing curved locking surfaces and a non-locking flat release surface disposed therebetween, each the locking surfaces selectively rotatable into engagement with one of a pair of bearing surfaces disposed on the rear mounting extension.

14. An adjustable stock assembly for a firearm, the stock comprising:

a longitudinal axis;

a chassis comprising a main body configured for mounting a receiver and an axially elongated rear mounting extension extending rearwardly from the main body;

a cam lever assembly mechanically coupled to the rear mounting extension, the cam lever assembly comprising a cam lever pivotably movable between a locking position and a release position;

the cam lever assembly further comprising a pair of spring-biased clamping blocks coupled to the rear mounting extension, the clamping blocks laterally movable together and apart via operation of the cam lever between a closed position and an open position;

a butt pad assembly comprising an elongated butt pad and an adjustment rail protruding axially forward from the butt pad into a longitudinal cavity of the rear mounting extension of the chassis, the adjustment rail received between the clamping blocks and slideable between a plurality of axial positions for adjusting a length of the butt pad;

the clamping blocks when in the closed position lockingly engaging the adjustment rail in one of the axial positions, and when in the open position allowing the adjustment rail to slide axially relative to the rear mounting extend between the axial positions; and a cheek rest slideably mounted to the rear mounting extension, the cheek rest slideable between a plurality of vertical positions on the rear extension;

the cam lever assembly operable to simultaneously lock both the butt pad assembly and cheek rest in one of the axial positions and vertical positions respectively.

15. The adjustable stock according to claim 14, further comprising an opening spring which biases the clamping blocks apart, the cam lever when in the locking position configured and operable to draw the clamping blocks together to lock the butt pad assembly in axial position.

16. The adjustable stock according to claim 15, wherein the cam lever assembly is a double-acting cam lever assembly, the cam lever having a cam head defining two opposing locking surfaces on opposite sides of the cam head which are selectively rotatable into engagement with a bearing surface on the rear mounting extension, and a non-locking release surface disposed therebetween; and the cam lever is pivotably movable between (1) a center release position allowing adjustment of the butt pad assembly and cheek rest, and (2) one of two opposing locking positions which lock the butt pad assembly and cheek rest in position.

17. The adjustable stock according to claim 14, wherein the cheek rest is mounted to the clamping blocks which are slideably disposed on the rear mounting extension of the chassis, the cheek rest being slideable with the clamping blocks between a plurality of axial positions relative to the rear mounting extension.

18. The adjustable stock according to claim 17, wherein the cheek rest is lockable in one of the plurality of axial positions by the cam lever assembly when the cam lever is in the locking position.

19. The adjustable stock according to claim 18, wherein opposing lateral sides of the cheek rest each comprise a vertically elongated adjustment leg each engageable with inwardly movable locking elements disposed on the cam lever assembly, the cam lever when in the locking position operable to lock the cheek rest in vertical position via engagement between the locking elements and adjustment legs.

20. An adjustable stock assembly for a firearm, the stock comprising:

a longitudinal axis;

a chassis configured for mounting a receiver thereto and comprising an axially elongated rear mounting extension extending rearwardly from the main body;

a locking mechanism slideably coupled to the rear mounting extension and changeable between a locked and unlocked position, the locking mechanism movable between a plurality of first longitudinal positions on the rear mounting extension;

a butt pad assembly slideably mounted to the rear mounting extension, the butt pad assembly slideable between a plurality of second longitudinal positions on the rear mounting extension for adjusting a length of pull of the firearm;

a cheek rest mounted to the locking mechanism, the cheek rest slideable with the locking mechanism between the plurality of first longitudinal positions on the rear extension;

the locking mechanism configured to simultaneously lock both the butt pad assembly in one of the second longitudinal positions and the cheek rest in one of first longitudinal positions;

wherein the locking mechanism is a cam lever assembly comprising a pivotable cam lever and a pair of spring-biased clamping blocks coupled to the rear mounting extension, the clamping blocks laterally movable together and apart via operation of the cam lever between a closed position locking the cheek rest and butt pad assembly in axial position and an open position allowing adjustment in axial position of the cheek rest and butt pad assembly;

wherein the butt pad assembly further comprises a vertically elongated recoil pad and a forwardly extending adjustment rail which is slideably received inside a longitudinal cavity of the rear mounting extension.

21. The adjustable stock according to claim 20, wherein the cheek rest is further slideably mounted to the locking mechanism on the rear mounting extension for vertical height adjustment, the cheek rest slideable between a plurality of vertical positions on the locking mechanism which is operable to further lock the cheek rest in one of the vertical positions.

22. The adjustable stock according to claim 21, wherein the cheek rest includes first and second downward extending adjustment legs arranged on opposite lateral sides of the mounting extension and slideably coupled to the locking mechanism for vertical height adjustment.

23. The adjustable stock according to claim 20, wherein at least one clamping block comprises a first portion having a first set of serrated teeth which engage mating teeth on the rear mounting extension and a second raised portion having a second set of serrated teeth which engage mating teeth on the adjustment rail of the butt pad assembly.

24. The adjustable stock according to claim 23, wherein the at least one clamping block engages the adjustment rail of the butt pad assembly through a lateral window formed in a lateral side of the rear mounting extension of the chassis.

25. The adjustable stock according to claim 20, wherein the cam lever assembly is ambidextrous such that the cam lever may be operably mounted on either a right or left lateral side of the firearm.

* * * * *